US012151147B2

(12) United States Patent
Hill et al.

(10) Patent No.: US 12,151,147 B2
(45) Date of Patent: Nov. 26, 2024

(54) GOLF CLUB FITTING SYSTEMS

(71) Applicant: Taylor Made Golf Company, Inc., Carlsbad, CA (US)

(72) Inventors: Brian Hill, Carlsbad, CA (US); Joseph Henry Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 224 days.

(21) Appl. No.: 17/566,263

(22) Filed: Dec. 30, 2021

(65) Prior Publication Data

US 2023/0103906 A1 Apr. 6, 2023

Related U.S. Application Data

(60) Provisional application No. 63/261,457, filed on Sep. 21, 2021.

(51) Int. Cl.
*A63B 60/42* (2015.01)
*A63B 53/02* (2015.01)
(Continued)

(52) U.S. Cl.
CPC ..... *A63B 60/42* (2015.10); *A63B 53/023* (2020.08); *A63B 53/08* (2013.01); *A63B 2053/0491* (2013.01)

(58) Field of Classification Search
CPC ..... A63B 53/02; A63B 53/06; A63B 60/42; A63B 53/005; A63B 53/021;
(Continued)

(56) References Cited

U.S. PATENT DOCUMENTS 749,174 A 1/1904 Davis
796,802 A * 8/1905 Brown ..... A63B 53/02 473/307
(Continued)

FOREIGN PATENT DOCUMENTS

JP 2005160947 6/2005
WO WO 2012/078258 6/2012

OTHER PUBLICATIONS

International Search Report and Written Opinion of the International Searching Authority for International Application No. PCT/US2011/057966, mailed Mar. 8, 2021, 8 pages.

*Primary Examiner* — Sebastiano Passaniti
(74) *Attorney, Agent, or Firm* — Klarquist Sparkman, LLP

(57) ABSTRACT

Golf club fitting systems can include a golf club head along with multiple alternative adjustment sleeves that each mate with the club head to modify loft and lie angles. Each adjustment sleeve can include a first portion having a respective longitudinal axis and configured to mate and coaxially align with a hosel of the golf club head, and a second portion having a respective longitudinal axis angularly offset from the longitudinal axis of the first portion and configured to mate and coaxially align with a golf club shaft. Each different adjustment sleeve can be configured to alter a position of the golf club head relative to a golf club shaft by a different adjustment value relative to each other. Fitting systems can also include a shaft sleeve that can join any of various different shafts with any of the adjustment sleeves. Fitting systems can also include additional club heads.

31 Claims, 9 Drawing Sheets

(51) Int. Cl.
*A63B 53/04* (2015.01)
*A63B 53/08* (2015.01)

(58) Field of Classification Search
CPC ... A63B 53/022; A63B 53/023; A63B 53/025; A63B 53/026; A63B 53/027; A63B 53/028
USPC ..... 473/287–288, 305–310, 244–248
See application file for complete search history.

(56) References Cited

U.S. PATENT DOCUMENTS 1,540,559 A 6/1925 Murphy
1,697,846 A 1/1929 Anderson
1,818,359 A 8/1931 Samaras et al.
1,879,117 A 9/1932 Davidson
2,001,342 A 5/1935 Dyce
2,027,452 A 1/1936 Rusing
3,765,241 A 10/1973 Lambert
3,825,991 A * 7/1974 Cornell ..... A63B 53/04 29/525.08
4,792,139 A 12/1988 Nagasaki et al.
4,795,159 A 1/1989 Nagamoto
4,943,059 A 7/1990 Morell
5,039,098 A 8/1991 Pelz
5,390,918 A 2/1995 Meyers
5,447,309 A 9/1995 Vincent
5,513,844 A 5/1996 Ashcraft et al.
5,839,973 A 11/1998 Jackson
5,906,549 A * 5/1999 Kubica ..... A63B 53/0466 473/314
5,931,742 A 8/1999 Nishimura et al.
6,027,416 A 2/2000 Schmidt et al.
6,652,388 B1 11/2003 Lenhof et al.
6,769,994 B2 * 8/2004 Boone ..... A63B 60/00 473/409
6,769,996 B2 8/2004 Tseng
6,890,269 B2 5/2005 Burrows
7,083,529 B2 8/2006 Cackett et al.
7,186,190 B1 3/2007 Beach et al.
7,207,897 B2 4/2007 Burch et al.
7,226,364 B2 6/2007 Helmstetter
7,300,359 B2 11/2007 Hocknell et al.
7,326,126 B2 2/2008 Holt et al.
7,335,113 B2 2/2008 Hocknell et al.
7,344,449 B2 3/2008 Hocknell et al.
7,354,353 B2 4/2008 Hocknell et al.
7,438,645 B2 10/2008 Hsu
7,465,239 B2 12/2008 Hocknell et al.
7,476,160 B2 1/2009 Hocknell et al.
7,530,900 B2 5/2009 Holt et al.
7,566,279 B2 7/2009 Nakashima
7,578,749 B2 8/2009 Hocknell et al.
7,611,422 B2 11/2009 Hocknell et al.
7,621,821 B2 11/2009 Tsai et al.
7,699,717 B2 4/2010 Morris et al.
7,736,243 B2 6/2010 Sanchez et al.
7,789,766 B2 9/2010 Morris et al.
7,789,769 B2 9/2010 Sugimoto
7,819,754 B2 10/2010 Evans et al.
7,824,277 B2 11/2010 Bennett et al.
7,850,540 B2 12/2010 Sander et al.
7,857,709 B2 12/2010 Burch
7,874,934 B2 1/2011 Soracco et al.
7,878,921 B2 2/2011 Bennett et al.
7,883,430 B2 2/2011 Thomas et al.
7,887,431 B2 2/2011 Beach et al.
7,892,107 B2 * 2/2011 Vald'Via ..... A63B 60/00 473/309
7,938,735 B2 * 5/2011 Lau ..... A63B 53/02 473/307
7,955,182 B2 6/2011 Thomas et al.
7,980,959 B2 7/2011 Morris et al.
7,997,997 B2 8/2011 Bennett et al.
8,002,644 B2 8/2011 Hocknell et al.
8,012,037 B2 9/2011 Evans et al.
8,033,932 B2 10/2011 Wada et al.
8,046,899 B2 11/2011 Burch
8,057,320 B2 11/2011 Bennett et al.
8,079,128 B2 12/2011 Sander et al.
8,096,895 B2 1/2012 Hocknell et al.
8,133,130 B2 3/2012 Morris et al.
8,133,131 B1 3/2012 Bennett et al.
8,142,306 B2 3/2012 De La Cruz et al.
8,147,350 B2 4/2012 Beach et al.
8,147,351 B2 4/2012 Bennett et al.
8,177,661 B2 5/2012 Beach et al.
8,182,357 B2 5/2012 Moore
8,216,084 B2 7/2012 Bennett et al.
D665,472 S 8/2012 McDonnell et al.
8,235,834 B2 8/2012 De La Cruz et al.
8,235,835 B2 8/2012 Soracco
8,235,836 B2 8/2012 Soracco et al.
8,235,837 B2 8/2012 Bennett et al.
8,235,839 B2 8/2012 Bennett et al.
8,235,840 B2 8/2012 Hocknell et al.
8,235,843 B1 8/2012 Rice et al.
8,257,193 B2 9/2012 Hocknell et al.
8,262,498 B2 9/2012 Beach et al.
8,272,972 B2 9/2012 Sato et al.
8,360,897 B2 1/2013 Morris et al.
8,376,874 B2 2/2013 Bennett et al.
8,382,607 B2 2/2013 Burnett et al.
8,403,770 B1 3/2013 Aguinaldo et al.
8,419,563 B2 * 4/2013 Sander ..... A63B 53/02 473/307
8,419,567 B2 4/2013 Jertson et al.
D682,378 S 5/2013 Holt et al.
D682,965 S 5/2013 Seluga et al.
8,449,404 B2 5/2013 Thomas et al.
8,496,541 B2 7/2013 Beach et al.
D687,502 S 8/2013 Oldknow et al.
D687,504 S 8/2013 Stokke et al.
8,517,855 B2 8/2013 Beach et al.
8,517,856 B2 8/2013 Bennett et al.
D689,575 S 9/2013 Oldknow et al.
8,523,701 B2 9/2013 Knutson et al.
8,535,173 B2 9/2013 Golden et al.
8,545,344 B2 10/2013 De La Cruz et al.
8,545,345 B2 10/2013 Lo et al.
8,561,876 B2 10/2013 Yamamoto
8,562,453 B2 10/2013 Sato
8,562,454 B2 10/2013 Burch
8,574,093 B2 11/2013 Sato et al.
8,585,511 B2 11/2013 Sato et al.
8,597,135 B2 12/2013 Sander et al.
8,602,907 B2 12/2013 Beach et al.
8,616,995 B2 12/2013 Thomas et al.
D697,156 S 1/2014 Seluga et al.
8,622,848 B2 1/2014 Bennett et al.
8,628,430 B2 1/2014 Sato et al.
8,632,417 B2 1/2014 Sander et al.
8,636,606 B2 1/2014 Sato
8,641,554 B1 2/2014 Hocknell et al.
8,668,597 B2 3/2014 Yamamoto
8,684,859 B1 4/2014 Aguinaldo et al.
8,696,486 B1 4/2014 Aguinaldo et al.
8,696,487 B2 4/2014 Beach et al.
8,715,103 B1 5/2014 Aguinaldo et al.
8,715,104 B1 5/2014 Wall, Jr. et al.
8,727,905 B2 5/2014 Murphy et al.
8,727,906 B1 5/2014 Aguinaldo et al.
8,747,248 B2 6/2014 Harvell et al.
8,777,771 B2 7/2014 Bennett et al.
8,790,191 B2 7/2014 Jertson et al.
8,795,099 B2 8/2014 Sato et al.
8,801,538 B2 8/2014 Knutson et al.
8,827,827 B2 9/2014 Yamamoto
8,845,450 B2 9/2014 Beach et al.
8,852,020 B2 10/2014 Bennett et al.
8,876,626 B2 11/2014 Suwa et al.
8,876,627 B2 11/2014 Beach et al.
8,926,447 B2 1/2015 Jerston et al.
8,932,147 B2 1/2015 Jerston et al.

(56) References Cited

U.S. PATENT DOCUMENTS 8,939,847 B2 1/2015 Sander et al.
D723,121 S 2/2015 Stokke et al.
8,961,329 B2 2/2015 Sander et al.
8,961,330 B2 2/2015 Zimmerman et al.
D725,729 S 3/2015 Song
D726,848 S 4/2015 Song
9,022,879 B2 5/2015 Sato
9,033,815 B2 5/2015 Sander et al.
9,044,652 B2 6/2015 Aguinaldo et al.
9,050,506 B2 6/2015 Boyd et al.
9,050,507 B2 6/2015 Boyd et al.
9,050,508 B2 6/2015 Kitagawa
9,053,256 B2 6/2015 Sander et al.
9,067,108 B2 6/2015 Aguinaldo et al.
9,072,947 B2 7/2015 Sander et al.
9,114,291 B2 8/2015 Bolane et al.
9,119,998 B1 9/2015 Wall, Jr. et al.
9,132,323 B2 9/2015 Beach et al.
9,144,719 B1 9/2015 Vrska et al.
9,144,720 B1 9/2015 Vrska et al.
9,174,097 B1 11/2015 Dacey et al.
9,180,348 B2 11/2015 Beach et al.
9,216,326 B2 12/2015 Beach et al.
9,259,626 B2 2/2016 Murphy et al.
9,283,445 B2 3/2016 Moore
9,320,947 B2 4/2016 Yamamoto
D757,194 S 5/2016 Stokke et al.
9,327,170 B2 5/2016 Solheim et al.
9,327,171 B2 5/2016 Knutson et al.
9,333,400 B2 5/2016 Girard et al.
9,345,935 B2 5/2016 Yamamoto
D760,335 S 6/2016 Song et al.
9,358,429 B2 6/2016 Vrska et al.
9,364,723 B2 6/2016 Harvell et al.
9,375,616 B2 6/2016 Zimmerman et al.
9,393,463 B2 7/2016 Bennett et al.
9,403,067 B2 8/2016 Zimmerman et al.
9,409,068 B2 8/2016 Arluna et al.
D767,058 S 9/2016 Oliveiro et al.
D773,576 S 12/2016 Schweigert
9,522,308 B2 12/2016 Sander et al.
9,539,474 B2 1/2017 Dacey et al.
9,561,404 B2 2/2017 Aguinaldo et al.
9,586,100 B2 3/2017 Boggs et al.
9,586,101 B2 3/2017 Motokawa
D783,104 S 4/2017 Oliveiro et al.
D783,748 S 4/2017 Song et al.
D785,111 S 4/2017 Song et al.
9,694,251 B2 7/2017 Stites et al.
9,694,252 B2 7/2017 Beach et al.
D795,371 S 8/2017 Stokke et al.
9,724,571 B2 8/2017 Burch
9,724,572 B2 8/2017 Mizutani et al.
9,737,767 B2 8/2017 Moore
9,744,411 B2 8/2017 Sander
9,757,627 B2 9/2017 Galvan et al.
9,757,628 B2 9/2017 Knutson et al.
9,764,203 B2 9/2017 Bennett et al.
9,782,640 B2 10/2017 Moore
9,782,641 B2 10/2017 Boggs et al.
9,814,942 B2 11/2017 Harvell et al.
9,849,348 B2 12/2017 Beach et al.
9,849,350 B2 12/2017 Dacey et al.
9,868,035 B2 1/2018 Clarke et al.
9,878,216 B2 1/2018 Zimmerman et al.
9,901,787 B2 2/2018 Boggs et al.
D812,165 S 3/2018 Kitching, Jr.
9,908,010 B2 3/2018 Boggs et al.
9,931,546 B2 4/2018 Mizutani
9,937,387 B2 4/2018 Wang et al.
9,993,698 B2 6/2018 Tassistro
10,004,951 B2 6/2018 Moore
10,010,768 B2 7/2018 Mizutani et al.
10,130,856 B2 11/2018 Boggs et al.
10,188,913 B2 1/2019 Bennett et al.
D840,483 S 2/2019 Boggs
10,220,267 B2 3/2019 Holtzman
D846,673 S 4/2019 Song et al.
10,245,487 B2 4/2019 Arluna et al.
10,272,297 B2 4/2019 Mizutani
10,272,298 B2 4/2019 Zimmerman et al.
D851,719 S 6/2019 Kim
10,307,646 B2 6/2019 Mizutani
10,322,326 B2 6/2019 Mizutani et al.
10,328,318 B2 6/2019 Onuki et al.
10,335,648 B2 7/2019 Kingston
10,350,463 B2 7/2019 Tassistro
10,363,469 B2 7/2019 Beach et al.
10,369,425 B2 8/2019 Mizutani et al.
10,398,946 B2 9/2019 Clarke et al.
D863,480 S 10/2019 Miao
D872,203 S 1/2020 Jertson et al.
10,549,160 B2 2/2020 Nivanh
10,596,421 B1 3/2020 Myers
10,786,716 B2 9/2020 Beach et al.
11,207,578 B2 12/2021 Beach et al.
11,779,815 B1 * 10/2023 Billings ..... A63B 53/023 473/307
2005/0009627 A1 1/2005 Willett et al.
2005/0049067 A1 * 3/2005 Hsu ..... A63B 53/06 473/244
2005/0148405 A1 7/2005 Imamoto
2006/0172816 A1 * 8/2006 Johnson ..... A63B 60/02 473/307
2006/0293115 A1 * 12/2006 Hocknell ..... A63B 60/00 473/305
2008/0176673 A1 7/2008 Morales et al.
2008/0280693 A1 11/2008 Chai
2009/0062029 A1 3/2009 Stites et al.
2009/0124407 A1 5/2009 Hocknell et al.
2009/0197694 A1 * 8/2009 Soracco ..... A63B 53/0466 473/307
2009/0286611 A1 11/2009 Beach et al.
2009/0286619 A1 11/2009 Beach et al.
2010/0197424 A1 8/2010 Beach et al.
2010/0234123 A1 9/2010 Sato et al.
2010/0292018 A1 11/2010 Cackett et al.
2011/0039631 A1 * 2/2011 Oldknow ..... A63B 60/00 473/305
2011/0047778 A1 * 3/2011 Sander ..... A63B 53/02 29/525.03
2011/0165961 A1 7/2011 Cackett et al.
2012/0071265 A1 * 3/2012 Thomas ..... A63B 53/0466 473/314
2012/0142445 A1 * 6/2012 Burnett ..... A63B 53/0466 473/307
2014/0256467 A1 9/2014 Lorentzen et al.
2015/0126300 A1 * 5/2015 Jertson ..... A63B 60/02 473/307
2015/0182815 A1 * 7/2015 Boggs ..... A63B 53/02 473/307
2017/0266518 A1 9/2017 Beach et al.
2018/0185711 A1 * 7/2018 Mizutani ..... A63B 53/02
2018/0318658 A1 11/2018 Beach et al.
2019/0105545 A1 4/2019 Beach et al.
2020/0197767 A1 * 6/2020 Morelock ..... A63B 53/007
2020/0282268 A1 * 9/2020 Lapuz ..... A63B 53/021

* cited by examiner

GOLF CLUB FITTING SYSTEMS

CROSS-REFERENCE TO RELATED APPLICATIONS

This application claims the benefit of U.S. Provisional Patent Application No. 63/261,457, filed Sep. 21, 2021, which is incorporated by reference herein.

FIELD

The present disclosure relates to golf club fitting systems and methods.

BACKGROUND

Golf clubs are typically manufactured with standard lie and loft angles. Some golfers, however, prefer to modify the lie and loft angles of their golf clubs in order to improve performance and consistency of their golf clubs, thereby improving their own golfing performance. A golf club fitting can help golfers find a desired lie and loft.

One of the problems with conventional golf club fittings, however, is that club fittings typically require multiple golf club heads to find a desired lie and loft for a single golf club model. Multiple club heads can burden club fitters with both the cost of buying and maintaining adequate inventory of each club head, as well as the labor and time involved in switching out each club head with a single golf club shaft to alter the lie and/or loft for the desired model when fitting a golfer. A typical club fitting for a single iron model, for instance, can require as many as five different club heads, each head differing by only a relatively small amount in lie and/or loft angle. In this case, in order to achieve an incremental change in the lie and/or loft using a conventional golf club fitting system, a different club head must be used for each incremental change. Thus, improved fitting systems and methods are desired.

SUMMARY

Disclosed herein are golf club fitting systems and methods. In a representative embodiment, a golf club fitting system can include a golf club head having a hosel, and a first adjustment sleeve and a second adjustment sleeve for adjusting the fit of a golf club to a golfer. The first adjustment sleeve can include a first portion and a second portion, the first portion having a first longitudinal axis and configured to mate and coaxially align with the hosel of the golf club head and the second portion having a second longitudinal axis angularly offset from the first longitudinal axis of the first portion and configured to mate and coaxially align with a golf club shaft. The second adjustment sleeve can include a first portion and a second portion, the first portion having a third longitudinal axis and configured to mate and coaxially align with the hosel of the golf club head and the second portion having a fourth longitudinal axis angularly offset from the third longitudinal axis of the first portion and configured to mate and coaxially align with a golf club shaft. An angle between the first and second longitudinal axes of the first adjustment sleeve can differ from an angle between the third and fourth longitudinal axes of the second adjustment sleeve. The first and second adjustment sleeves can be alternatives such that a club fitter can select either one of the first and second adjustment sleeves to mate with the hosel of the golf club head and a golf club shaft. The first adjustment sleeve can be configured to alter a position of the golf club head relative to a golf club shaft by a first adjustment value and the second adjustment sleeve can be configured to alter a position of the golf club head relative to a golf club shaft by a second adjustment value different from the first adjustment value. For each adjustment sleeve, no portion of a golf club shaft enters the hosel of the golf club head when the second portion mates with the golf club shaft and the first portion mates with the golf club head.

In some embodiments, the angle between the first and second longitudinal axes of the first adjustment sleeve can correspond to the first adjustment value and the angle between the third and fourth longitudinal axes of the second adjustment sleeve can correspond to the second adjustment value. In some embodiments, the hosel can include outwardly extending tabs and each adjustment sleeve can include an external ridge configured to receive the tabs of the hosel. In such embodiments, for each adjustment sleeve, no portion of a golf club shaft lies within or extends beyond a plane intersecting the external ridge of the adjustment sleeve when the second portion mates with the golf club shaft. In other such embodiments, for each adjustment sleeve, no portion of a golf club shaft lies within or extends beyond a plane intersecting the tabs of the hosel when the second portion of the adjustment sleeve mates with the golf club shaft and the first portion mates with the golf club head.

In some embodiments, the golf club fitting system can include three or more adjustment sleeves, each adjustment sleeve having a first portion and a second portion with respective longitudinal axes. In some embodiments, the first adjustment sleeve can be formed of a first material having a first mass and the second adjustment sleeve can be formed of a second material having a second mass. In such embodiments, the second mass can be less than the first mass. In some embodiments, the golf club head can be a first golf club head and the golf club fitting system can further include a second golf club head formed of a material having a mass that is less than a mass of a material forming the first golf club head.

In some embodiments, when the first adjustment sleeve mates with the hosel of the golf club head and a golf club shaft, the golf club head can form a first angle relative to the golf club shaft, and when the second adjustment sleeve mates with the hosel of the golf club head and receives a golf club shaft, the golf club head can form a second angle relative to the golf club shaft.

In another representative embodiment, a method for fitting a golf club to a golfer is provided. The method can include positioning a first adjustment sleeve of a golf club fitting system between a club shaft and a club head of a golf club to adjust the position of the club head relative to the club shaft by a first adjustment value while fitting the golf club to a golfer. The method can further include disassembling the first adjustment sleeve, the club shaft, and the club head when the first adjustment sleeve is positioned between the club shaft and club head to remove the first adjustment sleeve, and positioning a second adjustment sleeve of the golf club fitting system between the club shaft and the club head of the golf club when the first adjustment sleeve is removed, to adjust the position of the club head relative to the club shaft by a second adjustment value while fitting the golf club to the golfer. The method can also include comparing one or more properties of the golf club having the first adjustment sleeve positioned between the club shaft and club head to one or more properties of the golf club having the second adjustment sleeve positioned between the club shaft and club head.

In some embodiments, positioning a respective adjustment sleeve can include positioning the adjustment sleeve between the club shaft and club head in a first position to adjust the position of the club head relative to the club shaft by a first angle, and positioning the adjustment sleeve between the club shaft and club head in a second position to adjust the position of the club head relative to the club shaft by a second angle. In such embodiments, a magnitude of the first and second angles can be equal to a respective adjustment value. In some embodiments, a magnitude of the first and second angles can be equal.

In some embodiments, positioning a respective adjustment sleeve can include disassembling the adjustment sleeve and the club head while the adjustment sleeve is in a first position, rotating the adjustment sleeve relative to the club head from the first position to a second position, and assembling the adjustment sleeve and the club head while the adjustment sleeve is in the second position. In some embodiments, positioning a respective adjustment sleeve can include mating at least one tab outwardly extending from a hosel of the club head with at least one recess on an outer surface of the adjustment sleeve. In some embodiments, positioning a respective adjustment sleeve can include mating a splined outer surface of the club shaft with a splined inner surface of the adjustment sleeve.

In another representative embodiment, a golf club fitting system can include a golf club shaft sleeve, a golf club head having a hosel, a first adjustment sleeve, and a second adjustment sleeve separate from the first adjustment sleeve. Each adjustment sleeve can include an outer surface, an inner surface, and be configured to couple to the golf club shaft sleeve and golf club head in a first position and in a second position. When fitting a golf club to a golfer, the first adjustment sleeve can be configured to adjust an angle of the golf club head relative to the golf club shaft sleeve by a first angle while in the first position and a second angle while in the second position, and the second adjustment sleeve can be configured to adjust an angle of the golf club head relative to the golf club shaft sleeve by a third angle while in the first position and a fourth angle while in the second position. The first and second adjustment sleeves can be coupled to the hosel of the golf club head and a golf club shaft sleeve separately from one another such that a club fitter can interchange the first and second adjustment sleeves.

In some embodiments, the first and second angles can be equal in magnitude and the third and fourth angles can be equal in magnitude, where the magnitude of the first and second angles and the magnitude of the third and fourth angles are unequal. In some embodiments, for each adjustment sleeve, the outer surface can have a first longitudinal axis and the inner surface can have a second longitudinal axis angled relative to the first longitudinal axis. In such embodiments, the outer surface can include a first outer surface having the first longitudinal axis and a second outer surface having the second longitudinal axis and coaxially aligned with the inner surface such that the second outer surface is angularly offset from the first outer surface.

In some embodiments, the golf club fitting system can further include a golf club shaft coupled to the golf club shaft sleeve. For each adjustment sleeve, when the adjustment sleeve is coupled to the golf club shaft sleeve and the hosel of the golf club head, the golf club shaft can be spaced axially from the hosel of the golf club head. In such embodiments, an end of the golf club shaft coupled to the golf club shaft sleeve can be axially offset by a first length from an opening of the adjustment sleeve coupled to the golf club shaft sleeve and proximate the golf club shaft. In further embodiments, a shaft sleeve bore within the golf club shaft sleeve can be axially offset from the hosel of the golf club head by a second length, the second length being greater than the first length. In still further embodiments, the outer surface of the adjustment sleeve can include a lower outer surface and an upper outer surface, the lower outer surface having a third length that is greater than the first length and the second length. In some embodiments, the golf club shaft sleeve can include a threaded opening having a length that is greater than the third length. In some embodiments, the adjustment sleeve can circumferentially overlap the golf club shaft along the first length.

In some embodiments, for each adjustment sleeve, a plurality of longitudinally extending outer projections of the golf club shaft sleeve can be configured to mate with a plurality of longitudinally extending grooves of the inner surface of the adjustment sleeve. In some embodiments, for each adjustment sleeve, the golf club shaft sleeve, the hosel of the golf club head, and the adjustment sleeve can be configured to receive a screw extending therethrough. In such embodiments, when the golf club shaft sleeve, the hosel of the golf club head, and a respective adjustment sleeve are coupled to one another, the screw can be coaxially aligned with the inner surface of the adjustment sleeve. In other such embodiments, when the golf club shaft sleeve, the hosel of the golf club head, and a respective adjustment sleeve are coupled to one another, the screw can have a longitudinal axis that is angularly offset from a longitudinal axis of the outer surface of the adjustment sleeve. In some embodiments, when fitting the golf club to the golfer, the golf club shaft sleeve can be configured to adjust an angle of the golf club head relative to a golf club shaft by a third angle.

The foregoing and other objects, features, and advantages of the disclosed technology will become more apparent from the following detailed description, which proceeds with reference to the accompanying figures.

DETAILED DESCRIPTION

Figure 1:
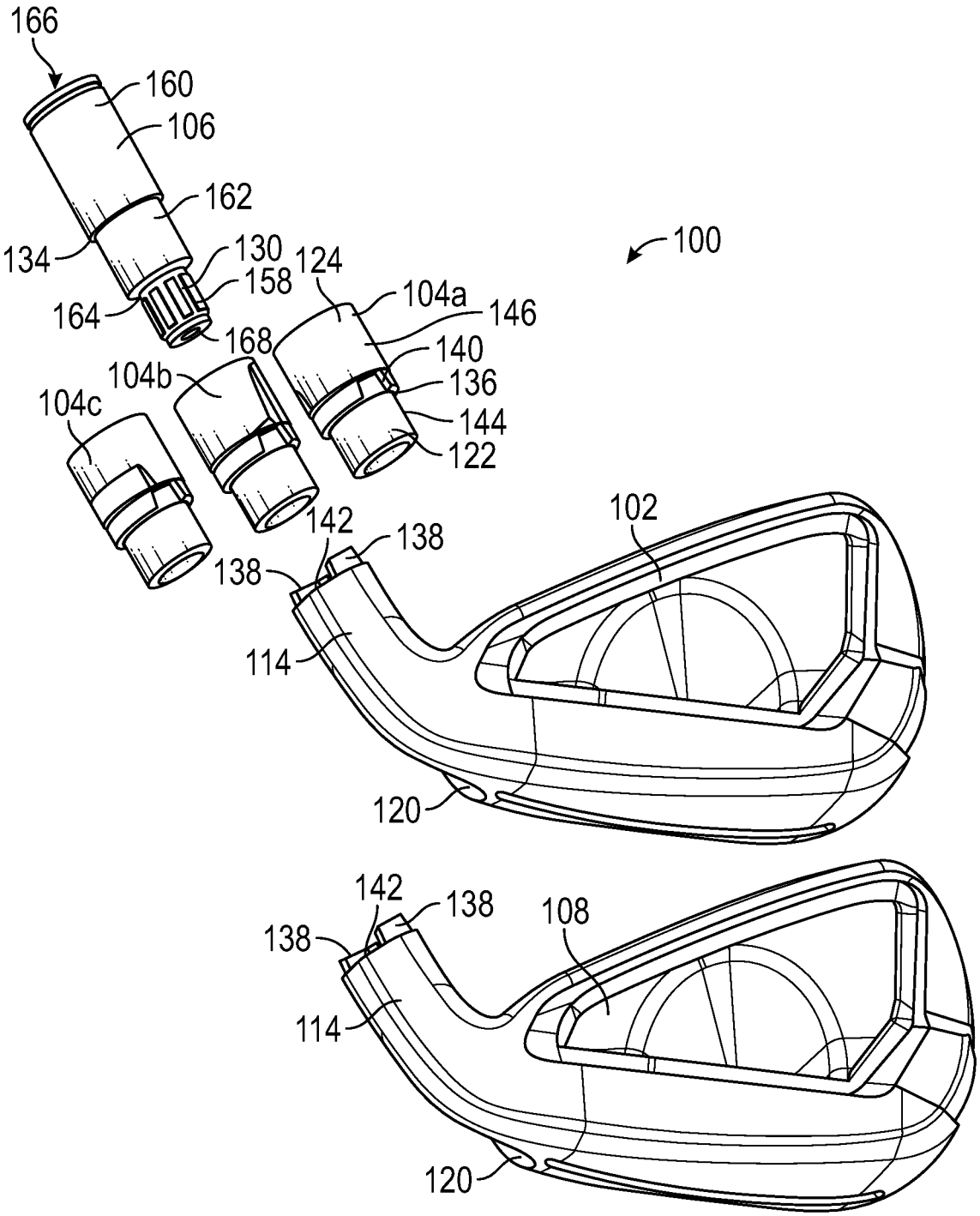
FIG. 1 illustrates an exemplary golf club fitting system.

As used in this application and in the claims, the singular forms "a," "an," and "the" include the plural forms unless the context clearly dictates otherwise. Additionally, the term "includes" means "comprises." Further, the term "coupled" and "connected" generally mean physically, mechanically, chemically, magnetically, and/or electrically coupled or linked and does not excluded the presence of intermediate elements between the coupled or associated items absent specific contrary language. As used herein, "and/or" means "and" or "or", as well as "and" and "or".

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved. Any theories of operation are to facilitate explanation, but the disclosed systems, methods, and apparatus are not limited to such theories of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. The actual operations that correspond to these terms will vary depending on the particular implementation and are readily discernible by one of ordinary skill in the art.

In some examples, values, procedures, or apparatus are referred to as "lowest", "best", "minimum," or the like. It will be appreciated that such descriptions are intended to indicate that a selection among many used functional alternatives can be made, and such selections need not be better, smaller, or otherwise preferable to other selections.

Examples are described with reference to directions indicated as "above," "below," "upper," "lower," and the like. These terms are used for convenient description, but do not imply any particular spatial orientation unless specifically defined.

The terms "lie angle," "loft angle," and "face angle" have well-understood meanings within the game of golf and the golf club industry. As used herein, these terms are intended to carry this conventional meaning. For instance, the term "lie angle" can refer to an angle formed between a central longitudinal axis of the shaft and the ground surface when the sole of the golf club head rests on flat ground. Also, the term "loft angle" can refer to an angle formed between a line normal to the center of the striking face of the club head and the ground when the sole of the golf club head rests on flat ground. Accordingly, the loft, lie, and face angles are geometrically independent of one another and can thereby be adjusted either independently or in combination with one another.

Described herein are golf club fitting systems that can be used to fit a golfer instead of conventional systems that include multiple golf club heads. The golf club fitting systems described herein include one or more adjustment sleeves and a corresponding club head, allowing the lie and/or loft angles of assembled fitting clubs to be altered with less time and effort, and without the need to store and maintain large inventory of various different club heads. Some disclosed club fitting systems can also be used with or include preexisting shaft sleeves, allowing the adjustment sleeves and club head(s) of the club fitting systems to be readily implemented.

Though the following description proceeds with reference to iron-type golf clubs and fitting systems for iron-type golf clubs, the golf club fitting systems described herein can be used for other types of golf clubs, such as woods, hybrids, rescues, wedges, and putters, and can be used for golf clubs made of any suitable material, in any size, and in any style.

In a typical club fitting for a single iron, the fitting process can require using as many as five different club heads to incrementally adjust the lie and/or loft when determining a desired lie and/or loft for a respective golfer. Each club head, in this case, generally differs by only a degree (or fraction thereof) in either the lie and/or loft. Table 1 below is an illustrative example. Specifically, the left most column of Table 1 lists five different golf club heads for a single iron model, each with a respective upright and flat configuration or weak and strong configuration to adjust the lie and/or loft, respectively. The two columns to the right of each club head indicate the incremental change in the lie and loft of a golf club made with each change in club head. As Table 1 demonstrates, in order to achieve a single incremental change in the lie and/or loft using a standard golf club fitting system, a different club head must be used each time.

TABLE 1

| | LOFT ±0.75° | LIE ANGLE ±0.75° |
|---|---|---|
| Club Head 1—3UP-STD | 27.5 | 64.5 |
| Club Head 2—2UP-1FL | | 63.5 |
| Club Head 4—1UP-2FL | | 62.5 |
| Club Head 4—1UP-2FL-("LITE") | | 62.5 |
| Club Head 5—2WK-1STR | 28.0 | 63.0 |

Moreover, irons, are generally available in different model categories, such as player, player distance irons, game improvement irons, and super game improvement irons. As such, fitters may recommend, or a player may desire, for example, a 7 iron in each of the four above-mentioned model categories, each 7 iron having a customized lie and/or loft. Fitting four different iron models then, can potentially require 20 different club heads to find a desired lie and loft of the four golf clubs (i.e., five club heads for each model). In contrast, the club fitting systems described herein require as little as four heads to fit the same four iron models (e.g., one head for each model). This is because the adjustment sleeves are universal and compatible across all models while still providing the same or similar range of adjustment provided using multiple club heads and conventional methods.

Further, iron models are typically on a one-to-two-year cycle. Meaning, every one to two years, iron models are replaced with a new and improved version of that model. The prior models can be outdated, no longer useable, and are often disposed. The adjustment sleeves disclosed herein, on the other hand, can be universal across different model years, thereby reducing waste and providing continuity and predictability year-to-year and cycle-to-cycle. The adjustment sleeves can also reduce manufacturing complexity because only a single fitting head may be needed for each model, as opposed to five or more different fitting heads for each model in conventional fitting systems. Additionally, given the uniqueness of each of the five plus fitting heads in a conventional fitting system, if one of the various fitting heads fails or is damaged or lost, it can be difficult to find a replacement fitting head. The adjustment sleeves of the fitting systems disclosed herein address this problem.

FIG. 1 depicts a golf club fitting system 100 according to a one representative embodiment. The club fitting system 100 can include three adjustment sleeves 104*a*, 104*b*, and 104*c* and two club heads 102 and 108. In some embodiments, the system includes just one club head such as the club head 102. In some embodiments, the fitting system 100 can also include a shaft sleeve 106. The three adjustment sleeves 104*a*, 104*b*, 104*c* and club heads 102, 108 of the club fitting system can be used to replace the several club heads used in a conventional golf club fitting, such as the standard fitting process described above in connection with Table 1. Each adjustment sleeve 104 can be positioned between a respective club head 102, 108 and a shaft sleeve 106 (FIGS. 6-10) and configured to alter the lie and/or loft of the golf club assembly incrementally by predetermined adjustment values (e.g., by a whole and/or fraction of a degree). The adjustment sleeves 104*a*-104*c*, for example, can be configured to adjust the position of each of the club head 102, 108 relative to a golf club shaft and/or shaft sleeve 106 by at least a first angle and a second angle. The first angle can be in a "positive" direction while the second angle can be equal in magnitude to the first angle and directed in a "negative" direction (i.e., in the opposite direction of the first angle). The predetermined adjustment value of an adjustment sleeve 104 can represent the magnitude of the negative and positive angles by which a respective adjustment sleeve 104 is configured to change the lie and/or loft of the club.

Figure 2:
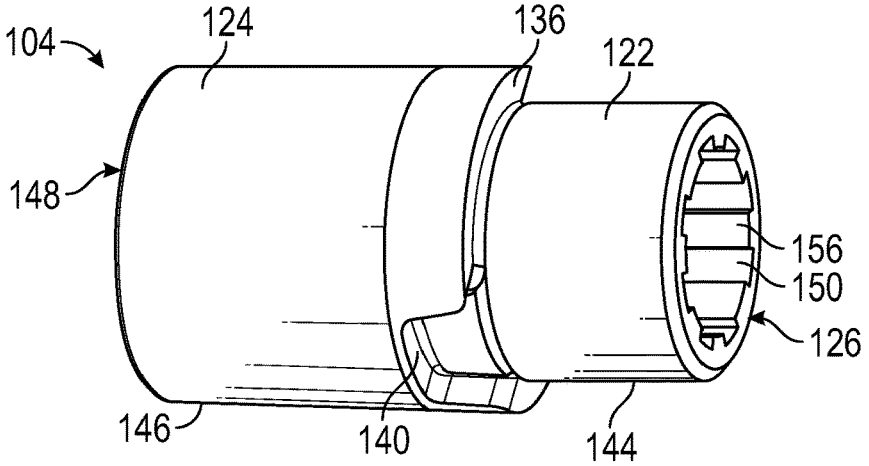
FIG. 2 is a perspective view of an adjustment sleeve of the fitting system of FIG. 1.
Figure 3:
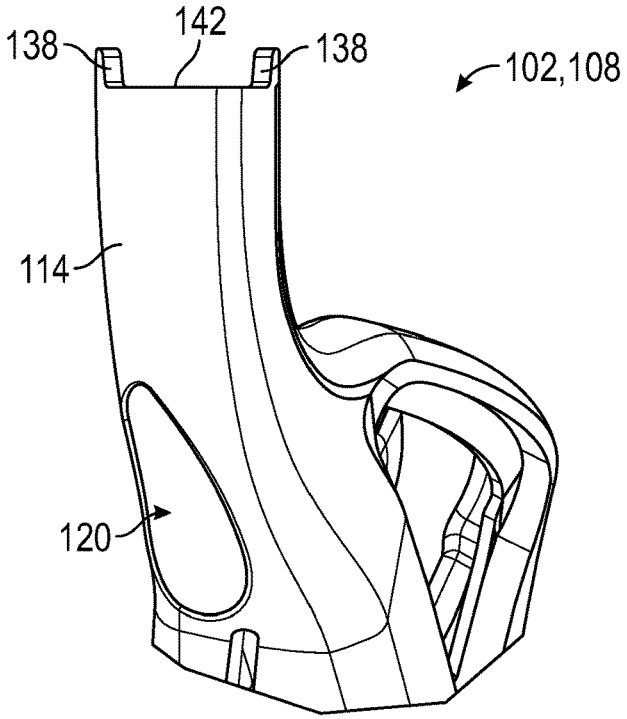
FIG. 3 shows a hosel of a golf club head of the fitting system of FIG. 1.

Referring to FIGS. 1-3, each club head 102, 108 can include a hosel 114 which forms a hosel bore or passageway that extends through the hosel 114, to an opening 120 within the sole, or bottom surface of the club head 102. Each club head 102, 108 can include a pair of tabs 138 outwardly extending from the upper most edge 142 of the hosel 114 in a longitudinal direction. These tabs 138 can be situated on diametrically opposing sides of the hosel 114 and configured to mate with one or more adjustment sleeves 104 of the fitting system 100.

Each club head 102, 108 of the club fitting system 100 can be a club head corresponding to a particular golf club (e.g., putter, iron, wood, etc.) and model category (e.g., players distance irons and game improvement irons). As one example, when fitting a golfer with a player distance 8 iron, either club head 102, 108 can be a corresponding player-distance-8-iron club head which can be used throughout the fitting process as the lie and/or loft are adjusted via the adjustment sleeves 104. This is in contrast to the conventional methods which would otherwise require as many as five different club heads to adjust the lie and/or loft of the club.

One of the two club heads 108 of the club fitting system 100 can be what is referred to as a "lite" club head, meaning the club head 108 has a weight or mass lighter than that of the other club head 102. Lite club heads 108 can be used, for example, to compensate for an increase in swing weight resulting from a relatively longer club shaft. The lite club head 108 can also be used in combination with a standard-length shaft to alter and achieve a desired swing weight. It should be appreciated that the club head 102 and lite club head 108 can be used interchangeably with the adjustment sleeves 104 described herein as desired.

As shown in FIGS. 1-3 and 5A, each adjustment sleeve 104 can have a first or "lower" portion 122 and a second or "upper" portion 124. Each lower portion 122 can define a first or lower outer surface 144 and each upper portion 124 can define a second or upper outer surface 146. The outer surface 144 of the lower portion 122 can have an outer diameter such that the bore of the hosel 114 can receive the lower portion 122 and the outer surface 144 is positioned flush with an inner surface or sidewalls of the hosel 114 (e.g., sidewalls 174). Alternatively, the outer diameter of the lower outer surface 144 can be less than an inner diameter of the hosel 114 such that a circumferential gap is formed between the lower outer surface 144 and the inner sidewalls of the hosel 114.

The upper outer surface 146 of each upper portion 124 can form an external ridge 136 that extends circumferentially around the outer surface of the adjustment sleeve 104 and proximate the lower portion 122. Along the external ridge 136 can be formed two or more recesses or notches 140 sized and shaped to receive the outwardly extending tabs 138 of the hosel 114 to mate with the adjustment sleeve 104 and hosel 114. More particularly, two diametrically opposing notches 140 of each adjustment sleeve 104 can be configured to mate with the diametrically opposing tabs 138 disposed along the upper most edge 142 of the hosel 114 of a respective club head 102, 108. In this way, each adjustment sleeve 104 can be positioned in a first position and a second position. Specifically, as the hosel 114 receives the lower portion 122 of a respective adjustment sleeve 104, the tabs 138 can mate with the notches 140 of the corresponding upper portion 124 in a first position. To move the adjustment sleeve 104 into the second position, the adjustment sleeve 104 can be rotated or otherwise positioned 180 degrees from the first position where each notch 140 receives the tab 138 diametrically opposite the tab 138 received in the first position. As will be described further, an adjustment sleeve 104 can adjust the angle of the club head 102, 108 relative to the shaft sleeve 106 by a first angle when in the first position and by a second angle when in the second position.

Although the tabs 138 and notches 140 are described as being in pairs arranged diametrically opposed to one another, any number of tabs and notches can be used and in any arrangement. The tabs and notches can, in some instances, also facilitate proper engagement between the adjustment sleeve and the shaft sleeve when the shaft sleeve 106, adjustment sleeve 104, and club head 102, 108 are assembled (e.g., proper engagement between internal and external splined surfaces). In some examples, the tabs 138 can assist in preventing rotation or movement of the adjustment sleeves 104 relative to a respective club head 102, 108 generally.

In some examples, the tabs 138 can have relatively longer length or extended height as the tabs 138 depicted. For instance, where the adjustment sleeve 104 and club head 102, 108 are made of dissimilar materials, such was when the adjustment sleeve 104 is made of an aluminum material, the extended tabs can provide increased stability between the adjustment sleeve 104 and hosel 114 of the club head 102, 108. In further examples, each adjustment sleeve 104 and/or club head can be color coded and/or include a visual marker to indicate adjustment value, positioning, lie, loft, upright, flat, etc.

Figure 4:
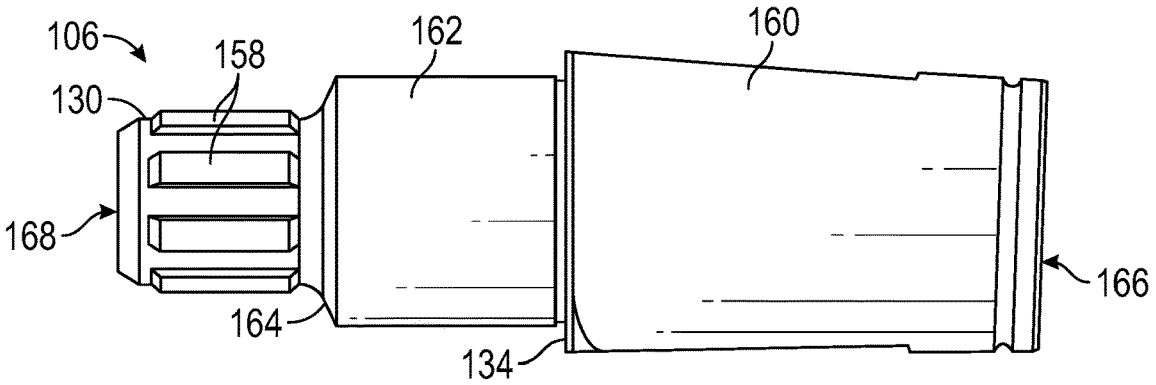
FIG. 4 shows a shaft sleeve of the fitting system of FIG. 1.

As shown in FIGS. 1 and 4, a shaft sleeve 106 of the fitting system 100 can include an upper portion 160, a middle portion 162, and a lower portion 130. The upper portion 160 can be configured to couple or mount to a lower, or tip-end portion of a golf club shaft 112 (FIGS. 6-10). For example, the upper portion 160 can have an upper opening 166 sized and shaped for receiving the tip-end portion of a shaft 112. In some examples, the shaft sleeve 106 can be removably coupled and/or adhesively bonded, welded, or otherwise secured to the golf club shaft 112. In other examples, the shaft sleeve 106 can be integrally formed as part of the tip end portion of the shaft 112. Accordingly, the shaft sleeve 106 can, in some instances, be included with and accompany the golf club fitting system 100, while in other instances, the shaft sleeve 106 can be a pre-existing shaft sleeve which can be advantageously incorporated and used with the adjustment sleeves 104 and club heads 102, 108 described herein. Generally, when coupled to one another, the upper, middle, and lower portions 160, 162, 130 of the shaft sleeve 106 and the tip end of the club shaft 112 can be coaxially aligned with one another such that the shaft sleeve 106 and club shaft 112 share a common longitudinal axis.

As show in FIGS. 1 and 4, the boundary between the upper portion 160 and the middle portion 162 includes an upper annular surface 134 and the boundary between the middle portion 162 and the lower portion 130 forms a lower annular surface 164. The upper annular surface 134, for example, can be perpendicular or semi-perpendicular to the external surface of the middle portion 162 and form an outer ridge which can bear against a respective adjustment sleeve 104 when the adjustment sleeve receives the shaft sleeve 106 (FIGS. 6-10).

The lower portion 130 of the shaft sleeve 106 can also include a plurality of external projections or splines 158 elongated in a direction parallel to a longitudinal axis of the shaft sleeve 106. In some embodiments, the outer surface of the lower portion 130 can include eight external splines 158 circumferentially spaced from one another, which can form a corresponding groove or gap between each pair of adjacent pair of external splines 158. Other embodiments can include a different number of splines. Additionally, the lower portion 130 can include an internally threaded opening 168 for receiving a screw 116 (FIGS. 6-10) therethrough.

Figure 5A:
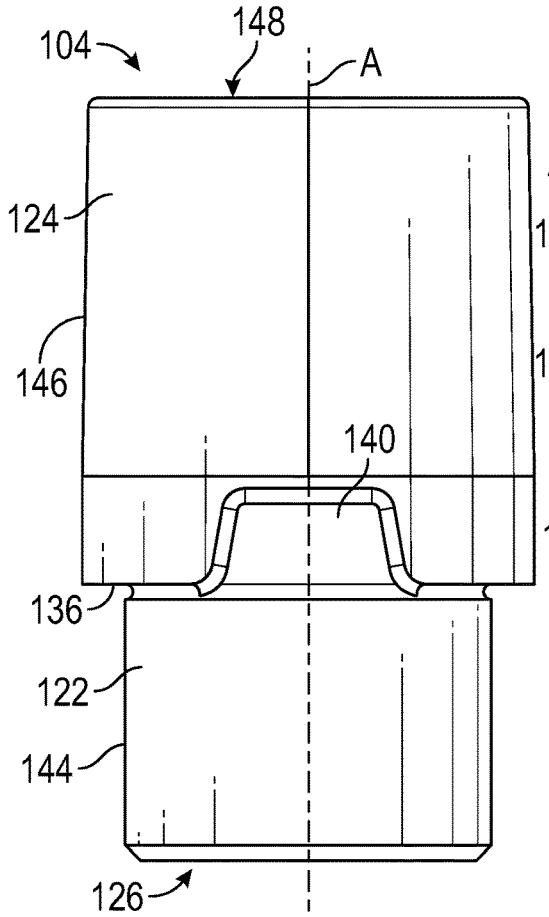
FIG. 5A is a side elevation view of the adjustment sleeve of FIG. 2.
Figure 5B:
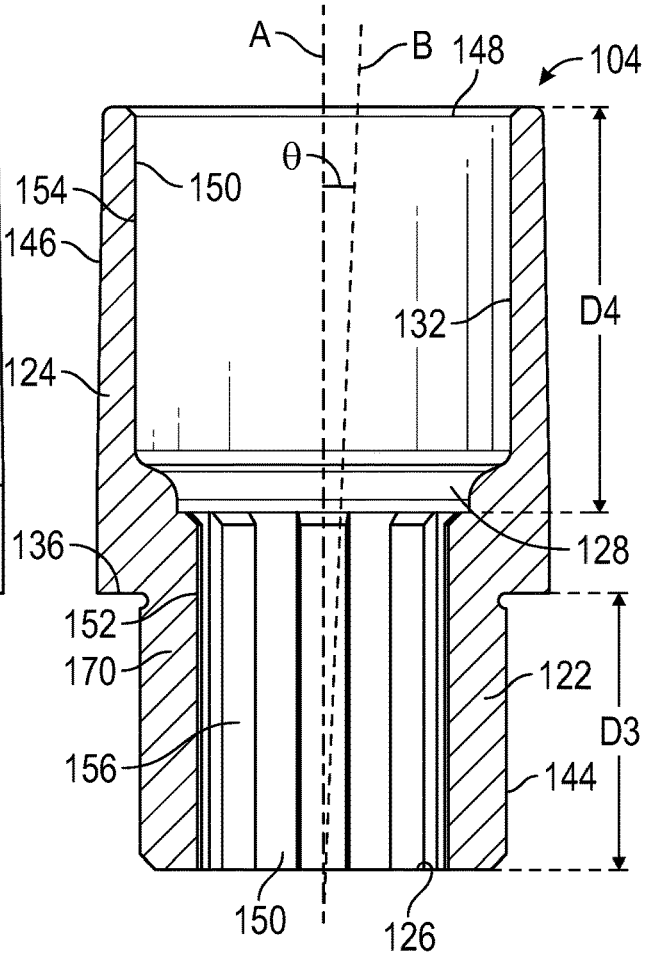
FIG. 5B is a cross-sectional view of the adjustment sleeve of FIG. 5A, taken along a longitudinal axis.
Figure 5C:
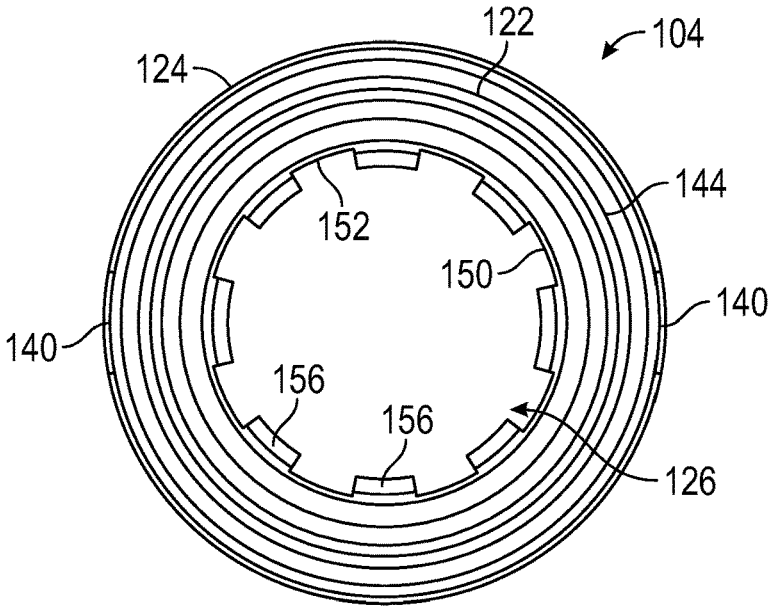
FIG. 5C is a top view of the adjustment sleeve of FIG. 5A, viewed along a longitudinal axis extending through the center of the adjustment sleeve.

Referring now to FIGS. 5A-5C, the lower and upper portions 122, 124 of each adjustment sleeve 104 can define a first opening 126 at one end of the adjustment sleeve and a second opening 148 at the other end of the adjustment sleeve. Extending between the first opening 126 and the second opening 148 can be an inner surface 150 of the adjustment sleeve 104. Also, situated between the first and second openings 126, 148 can be a third opening or transition 128 where the inner surface 150 transitions from a first segment 152 to a second segment 154. In particular, a first segment 152 of the inner surface 150 can extend between the first opening 126 and the transition 128 and the second segment 154 of the inner surface 150 can extend between the transition 128 and the second opening 148. As such, the first segment 152 can span that portion of the inner surface 150 extending through the lower portion 122 and partially into the upper portion 124, while the second segment 154 extends from the first segment 152 through the remainder of the upper portion 124, to the second opening 148. It is understood, however, that the first and segments 152, 154 can have different lengths and/or proportions relative to one another than that which is depicted in FIGS. 5A-5C.

The first and second segments 152, 154 can be configured to receive respective portions of the shaft sleeve 106. In particular, the first segment 152 can be sized and shaped to receive the lower portion 130 of the shaft sleeve 106 and the second segment 154 can be sized and shaped to receive the middle portion 162 of the shaft sleeve 106. For example, the upper portion 124 of the adjustment sleeve 104 can form a sleeve bore 132 sized and shaped to receive and the middle portion 162 such that the upper portion 124 encircles or surrounds the middle portion 162. The inner surface 150 of each adjustment sleeve 104 can also be configured to receive and contact the boundary between the lower portion 130 and the middle portion 162 of a shaft sleeve 106. Particularly, the transition 128 of the inner surface 150 can be sized and shaped to receive and bear against the lower annular surface 164.

As illustrated in FIGS. 5B and 5C, the first segment 152 of the inner surface 150 extending between the first opening 126 and the second opening 148 can form a keyway configured to receive a keyed portion of the shaft sleeve 106. For instance, the inner surface 150 along the first segment 152 can include a plurality of internal projections or splines 156 elongated in a direction parallel to a longitudinal axis of the inner surface 150 of the adjustment sleeve 104 (e.g., longitudinal axis B). As shown in FIG. 5C, the inner surface 150 can include eight internal splines 156 circumferentially spaced along the inner surface 150 such that a corresponding groove or gap is formed between each pair of adjacent internal splines 156. The internal splines 156 and the gaps therebetween can, for example, be configured to complimentarily mate with the plurality of external splines 158 located on the outer surface of the lower portion 130 of the shaft sleeve 106 (FIG. 4). For instance, each gap between an adjacent pair of internal splines 156 of the inner surface 150 can receive a corresponding external spline 158 of the lower portion 130 of the shaft sleeve 106 as the first segment 152 receives the lower portion 130. Although described as having eight complementary internal and external splines, the inner surface 150 and shaft sleeve 106 can include any fewer or greater number of commentary splines. The arrangement and number of internal and external splines can, in some cases, help to prevent relative rotation between the adjustment sleeve 104 and the shaft sleeve 106 and/or determine the position of the shaft sleeve 106 relative to the adjustment sleeve 104.

Further details regarding the advantages and configurations of the internal and external splines, including the manner in which the internal and external splines can be used to mate the shaft sleeve and adjustment sleeve can be found, for example, in U.S. Pat. No. 10,786,716, which is incorporated herein by reference in its entirety.

Accordingly, when the adjustment sleeve 104 and shaft sleeve 106 are mated in this way, the inner surface 150, including the first and second segments 152, 154, can be coaxially aligned with the lower and middle portions 130, 162 of the shaft sleeve 106. More particularly, the lower portion 130 of the shaft sleeve 106 can be coaxially aligned with the first segment 152 of the inner surface 150, such as to ensure proper mating between the external splines 158 of the lower portion 130 and the internal splines 156 the inner surface 150. The middle portion 162 of the shaft sleeve 106 in a similar manner can be coaxially aligned with the second segment 154 defining the sleeve bore 132 of the upper portion 124. In a like manner, the hosel 114 and lower portion 122 of the adjustment sleeve 104 received by the hosel 114 can be coaxially aligned along a longitudinal axis of the hosel 114.

The adjustment sleeves 104 described herein can be configured to adjust the angle of the club head 102, 108 relative to the shaft sleeve 106 by a first angle when in the first position and by a second angle when in the second position. These adjustments can, for instance, be achieved by angularly offsetting certain portions of each adjustment sleeve relative to other portions of the adjustment sleeve. In particular, as illustrated in FIG. 5B, the body 170 of the lower portion 122 of the adjustment sleeve 104 defining the lower outer surface 144 can be axially aligned along a first longitudinal axis A. In comparison, the inner surface 150 of each adjustment sleeve 104, including the first and second segments 152, 154, and the outer surface 146 of the upper portion 124 can be coaxially aligned with one another along a longitudinal axis B. Longitudinal axis B, for instance, can extend through center of both the first opening 126 and the second opening 148. As shown in FIG. 5B, the longitudinal axis A and longitudinal axis B can be angularly offset from one another by an angle θ such that the upper outer surface 146 and inner surface 150 of the adjustment sleeve 104 are angularly offset from the outer surface 144 of the lower portion 122. In this way, one portion of the adjustment sleeve 104 can be said to have a first longitudinal axis and another portion of the adjustment sleeve 104 can be said to have a second longitudinal axis angularly offset from the first longitudinal axis. It is this relative angular positioning between the longitudinal axes A, B which configures the adjustment sleeve 104 to provide a particular angle of adjustment (i.e., adjustment value) and in a direction corresponding to a desired change in the lie and/or loft. Specifically, via the coaxial relationship between the hosel 114 and the lower portion 122 of the adjustment sleeve 104, and the coaxial relationship between inner surface 150, upper portion 124, and shaft sleeve 106, the respective club head 102, 108 can be angled relative to a longitudinal axis of the shaft sleeve 106 and club shaft 112 at an angle equal or substantially equal to the to the angle θ. Angle θ, for instance, can correspond to the adjustment value of the respective adjustment sleeve 104. The direction in which the longitudinal axes A, B are angularly offset from one another when the adjustment sleeve 104 is situated between a respective shaft sleeve 106 and club head 102, 108, can also correspond with a direction suitable to change the lie, loft, and/or lie and loft of the club assembly, i.e., whichever adjustment the respective adjustment sleeve 104 is formed to alter.

For example, as previously described, each adjustment sleeve 104 can be configured to mate with tabs 138 of a respective club head 102, 108 in a first position and in a second position. The second position, for instance, can be 180 degrees relative to the first position. As such, the direction in which the longitudinal axis B is angularly offset from the longitudinal axis A when the adjustment sleeve 104 is in the first position can angle a respective golf club head 102, 108 (i.e., by angle θ) relative to the shaft sleeve 106 and club shaft 112 in a first or positive direction to adjust the corresponding lie and/or loft (e.g., where the toe of the club head tips downward when lie is altered). Likewise, when the adjustment sleeve 104 is a in the second position, the direction in which the longitudinal axes A, B are angularly offset from one another can angle the respective golf club head 102, 108 (i.e., by angle θ) relative to the shaft sleeve 106 and club shaft 112 in a second or negative direction opposite the positive direction (e.g., where the toe of the club head tips upward when the lie is altered). Thus, in representative examples, each adjustment sleeve 104 of the club fitting system 100 can be situated between the club head 102 and shaft sleeve 106 in a first position and configured to alter the lie and/or loft of the club by a given predetermined adjustment value (e.g., +1.5 degrees). The same adjustment sleeve 104 can then be situated between the club head 102 and shaft sleeve 106 in a second position in which the adjustment sleeve alters the lie and/or loft by the same magnitude and in the opposite direction of change as when the adjustment sleeve is in the first position (e.g., -1.5 degrees).

In some embodiments, the adjustment sleeves 104*a*-104*c* can be configured to adjust the lie and loft independently of one another during fitting. In some examples, two of the three adjustment sleeves 104*a*, 104*b* of the club fitting system 100 can be configured to adjust the lie of the club, while the third adjustment sleeve 104*c* can be configured to adjust the loft of the club. As mentioned, each lie adjustment sleeve 104 can be constructed to provide both positive and negative angle adjustments. As such, one lie adjustment sleeve 104 can alter the lie by a first adjustment value, and another adjustment sleeve 104 can alter the lie by a second adjustment value. These first and second adjustment values can differ in magnitude. For instance, one adjustment sleeve 104*a* can alter the lie value by an adjustment value of ±0.5 degrees, while the other lie adjustment sleeve 104*b* can alter the lie by an adjustment value of ±1.5 degrees. In a similar manner, the loft adjustment sleeve 104*c* can alter the loft of the club by respective adjustment values, such as by ±0.5 degrees and/or ±1.5 degrees. Although described with particularity, the adjustment sleeves 104 described herein can be configured to provide any suitable adjustment value, such as ±3.0 degrees and/or in any increment in between (e.g., in increments less than or greater than 0.5 degrees). In some examples, the club fitting system 100 can include two lie adjustment sleeves and two loft adjustment sleeves. One of each lie and loft adjustment sleeves 104, for example, can have an adjustment value of ±0.5, while the other lie and loft adjustment sleeves 104 can have an adjustment value of ±1.5. In further examples, the club fitting systems can include any fewer or greater number of adjustment sleeves configured to provide any variation of change in the lie and/or loft of the club.

One or more adjustment sleeves 104 can also be configured to alter the lie and loft of the club at the same time, such as via the direction the longitudinal axes A, B are angularly offset from one another when positioned between the shaft sleeve 106 and respective club head 102, 108. For instance, rather than having two diametrically opposing tabs 138 disposed atop the hosel 114, as many as four or more tabs 138 can be included to engage with a corresponding number of notches 140 of the adjustment sleeves 104. In such examples, the number of internal and external splines 156, 158 of the adjustment sleeves 104 and shaft sleeve 106 can be increased to twelve or more to allow for both the lie and loft to be adjusted at the same time with a single adjustment sleeve 104. As one example, where the hosel 114 has four outwardly extending tabs 138, the adjustment sleeve 104 can be rotated in 90 degree increments to adjust for both lie and loft, rather than altering lie and loft independently as described above. In other examples, any number of tabs, notches, and/or splines can be used.

In some embodiments, the shaft sleeve 106 can also be angularly offset and used in conjunction with adjustment sleeves 104 to alter the lie and/or loft along a wider range of incremental change (e.g., ±3.0 degrees or greater). As one example, a sleeve bore 172 within the shaft sleeve 106 (FIGS. 7 and 9-10) which receives a tip end portion of the shaft 112 can have a non-coaxial relationship with the rest of the shaft sleeve 106 and inner and outer portions of the adjustment sleeve 104. As such, the shaft sleeve 106 can be angularly offset from a longitudinal axis of the shaft 112 and inner and outer portions of the adjustment sleeve 104, such that a respective club head 102, 108 is angled relative to the club shaft 112 in addition to the angle of adjustment provided by a respective adjustment sleeve 104.

To illustrate, Table 2 below shows how a target adjustment angle in the lie and/or loft of a club can be achieved using the adjustment sleeves 104. Table 2 shows the club fitting system 100 can include two lie adjustment sleeves 104, one with an adjustment value of ±0.5 and the other with an adjustment value of ±1.5. As shown in Table 2, these lie adjustment sleeves 100 can be used in conjunction with an angled shaft sleeve 106 having a respective angle of ±1.5 degrees to cover incremental changes over ±3.0 degrees of lie adjustment. The adjustment sleeves 104 can, for instance, be rotated between first and second positions to provide both corresponding positive and negative adjustment values and/or can be interchanged with one another to provide different magnitudes of adjustment values (e.g., from a ±0.5 degree adjustment value to a ±1.5 degree adjustment value). In this way, a fitter can alter the lie over a range of ±3.0 degrees.

As one specific example and in reference to Table 2, to reach a target adjustment angle of 1 degree in the lie of a club, the adjustment sleeve 104 which has an adjustment value of ±0.5 can be positioned (e.g., in a second position) to provide a −0.5 degree change in the lie with the angled shaft sleeve 106 having a respective +1.5 degree angle. Table 2 shows the remaining combination of adjustment sleeve 104 and shaft sleeve 106 configurations that achieve each target adjustment from +3 degrees of lie adjustment, to −3 degrees of lie adjustment. In a similar manner, Table 3 shows that a similar process can be used to alter the loft of the club over a range of ±2 degrees with the same angled shaft sleeve 106. Although described as being used in combination with the angled shaft sleeves, the adjustment sleeves 104 described herein can achieve similar adjustments without the shaft sleeve having a respective angle.

TABLE 2

| | Lie | | | | | | |
|---|---|---|---|---|---|---|---|
| Target (in degrees) | 3 | 2 | 1 | 0 | −1 | −2 | −3 |
| Adj Sleeve Angle | 1.5 | 0.5 | −0.5 | −1.5 | 0.5 | −0.5 | −1.5 |
| Shaft Sleeve Angle | 1.5 | 1.5 | 1.5 | 1.5 | −1.5 | −1.5 | −1.5 |

TABLE 3

| | Loft | | | | | | |
|---|---|---|---|---|---|---|---|
| Target (in degrees) | 3 | 2 | 1 | 0 | −1 | −2 | −3 |
| Adj Sleeve Angle | 1.5 | 0.5 | −0.5 | −1.5 | 0.5 | −0.5 | −1.5 |
| Shaft Sleeve Angle | 1.5 | 1.5 | 1.5 | 1.5 | −1.5 | −1.5 | −1.5 |

Accordingly, each adjustment sleeve 104 can be rotated and/or interchanged with any one of the other adjustment sleeves 104*a*-104*c*, to alter the lie and/or loft by a respective adjustment value without the need for switching out multiple club heads. For instance, when fitting a golf club to a golfer, a first adjustment sleeve 104 can be selected and positioned in a first position between a respective club head 102, 108 and shaft sleeve 106 (and shaft 112) to adjust the lie and/or loft of the golf club assembly by a corresponding adjustment value. To alter the lie and/or loft of the golf club assembly further, a fitter can disassemble the club assembly and rotate (or otherwise position) the first adjustment sleeve 104 to a second position and/or interchange the first adjustment sleeve 104 with an alternative adjustment sleeve. The fitter can then reassemble the components of the club assembly such that the first adjustment is positioned between the respective club head in the second position and/or a second selected adjustment sleeve 104 is positioned between the club head 102, 108 and shaft sleeve 106. While fitting a golf club to a golfer, the fitter can compare one or more respective properties of the golf club's performance with each change in adjustment value and/or adjustment sleeve 104. Based on the performance properties across different adjustment values and/or adjustment sleeves 104, the fitter can select a desired lie and/or loft for the golfer and/or can determine that further adjustment is desired. Such properties of performance can include distance, backspin, accuracy, bounce, and/or a variety of other properties suitable for fitting the golf club to the golfer.

Figure 6:
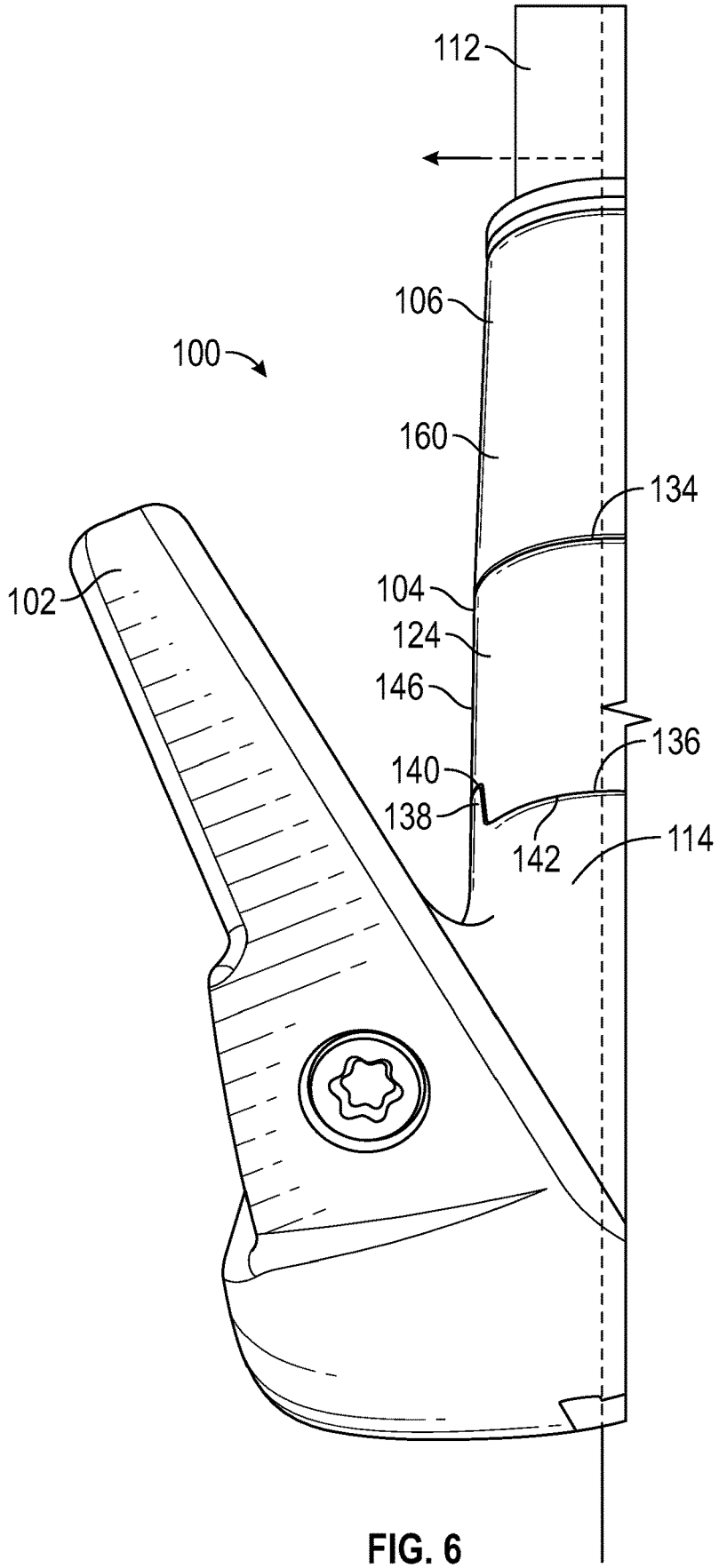
FIG. 6 is a partial view of an assembled golf club that includes selected components of the fitting system of FIG. 1.
Figure 7:
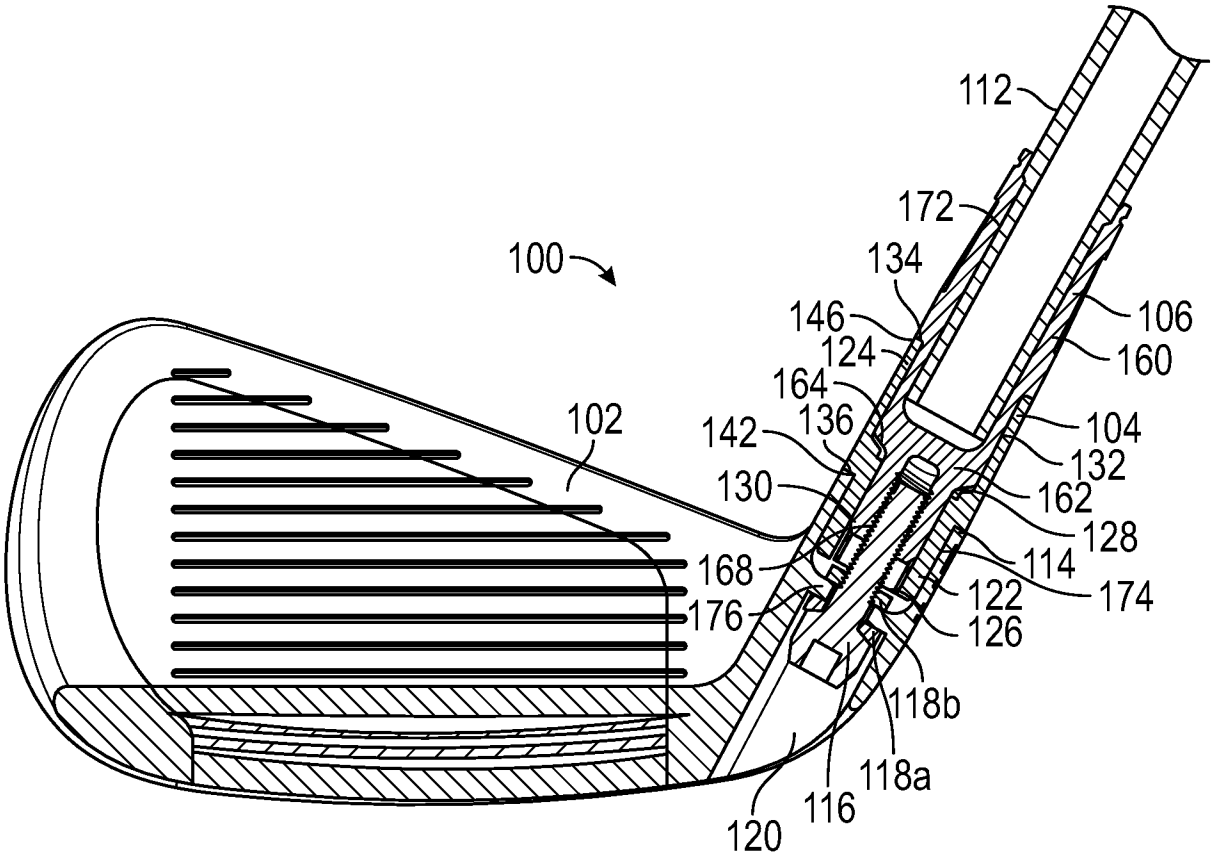
FIG. 7 is a cross-sectional view of the golf club of FIG. 6, taken along a plane of the hosel axis.
Figure 8:
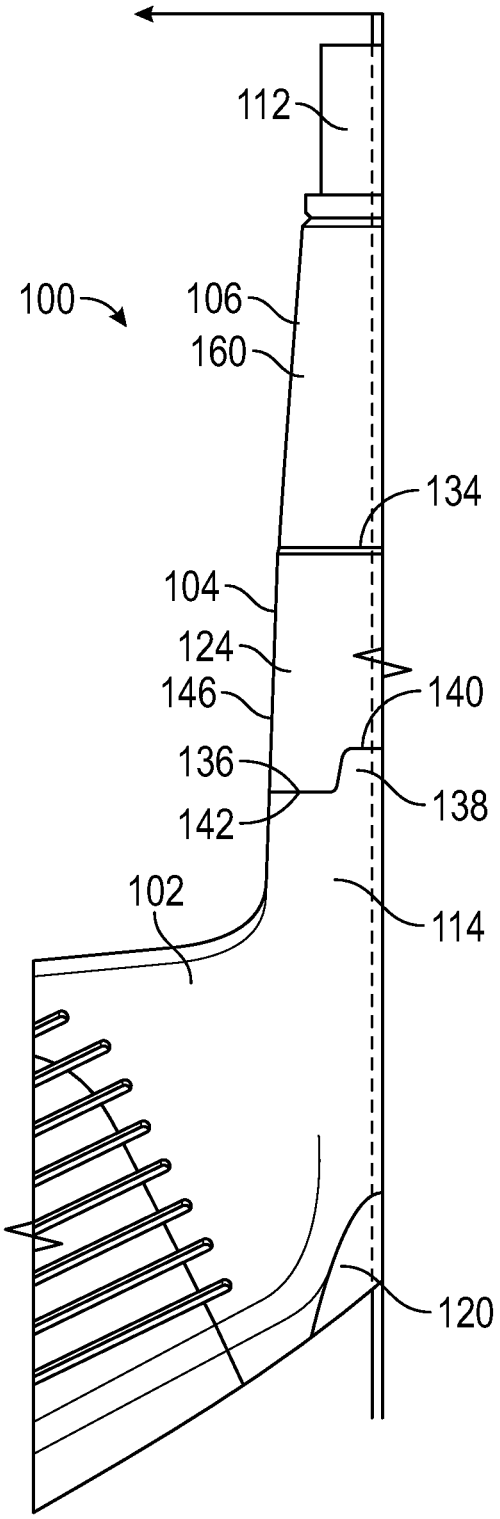
FIG. 8 is another partial view of the golf club of FIG. 6.
Figure 9:
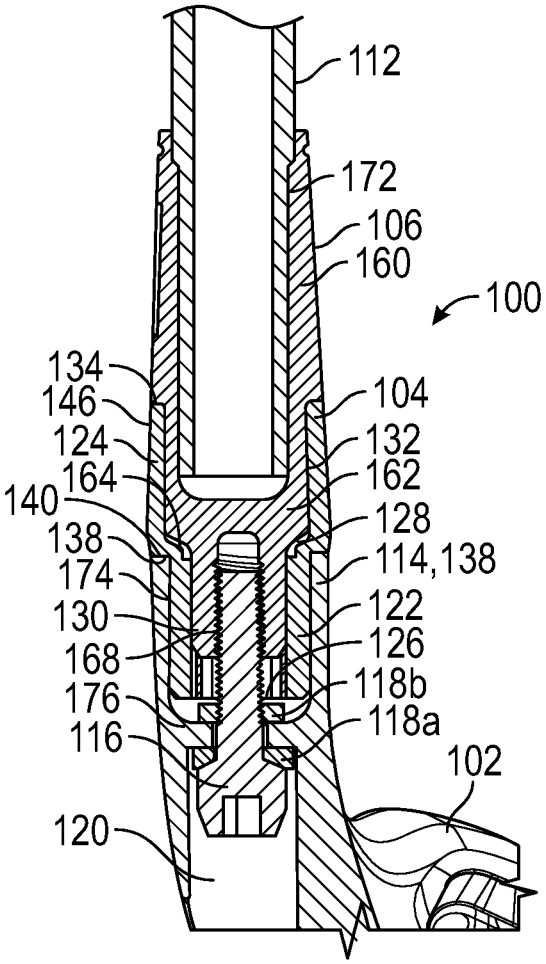
FIG. 9 is a cross-sectional view of the golf club of FIG. 6, taken along another plane of the hosel axis that is perpendicular to that of FIG. 7.
Figure 10:
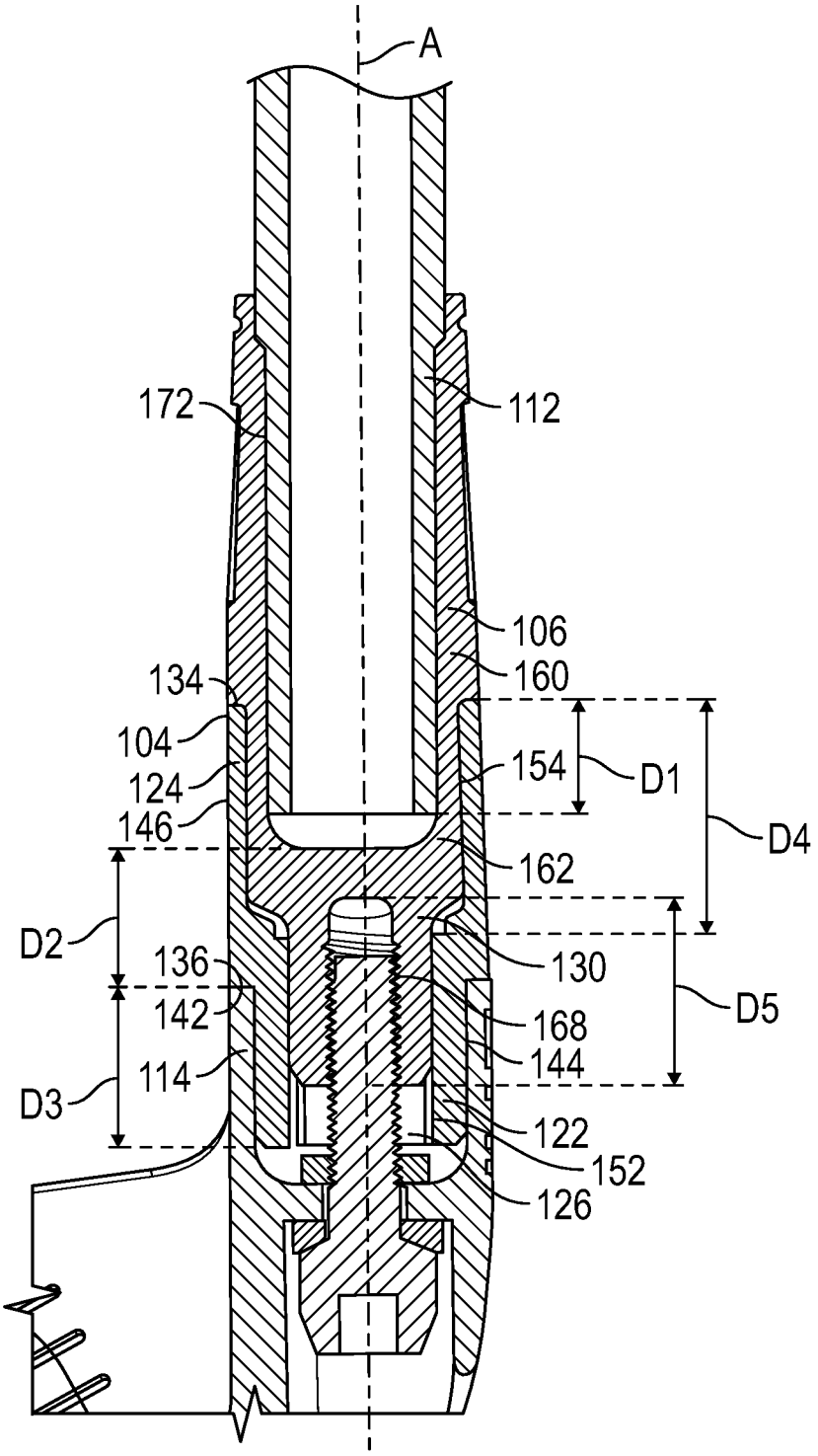
FIG. 10 is another cross-sectional view of the golf club of FIG. 6, taken along the plane of the hosel axis shown in FIG. 7.

FIGS. 6-10 depict a representative implementation of the club fitting system 100 when assembled. For example, the illustrated example of FIGS. 6-10 shows an adjustment sleeve 104 coupled to and situated between a respective shaft sleeve 106 and club head 102 (and/or lite club head 108). FIGS. 6-7 and 10 in particular, depict a cross-sectional view of the assembled golf club fitting system 100 taken between the tabs 138 of the hosel 114 of the club head 102, while FIGS. 8 and 9 depict a cross-sectional view of the assembled golf club fitting system 100 taken through the tabs 138. When assembled, the sleeve bore 172 of the shaft sleeve 106 receives a tip-end portion of a shaft 112, the adjustment sleeve 104 receives the lower and middle portions 130, 162 of the shaft sleeve 106, and the hosel 114 of the club head 102 receives the lower portion 122 of the adjustment sleeve 104.

As shown in FIGS. 7 and 9, the hosel 114 of the club head can include hosel sidewalls 174 and a flange 176 which extends radially inwardly from the sidewalls 174 to form a bottom of the hosel 114. To secure the club head 102, adjustment sleeve 104, and shaft sleeve 106 to one another, a screw 116 and pad assembly 118*a*-118*b* can be employed. In particular, the screw 116 can positioned inside the opening 120 within the sole of the club head 102 and extend through the flange 176 within the hosel 114 and the first opening 126 of the adjustment sleeve 104. The screw 116 can extend into and engage the threaded opening 168 within the lower portion 130 of the shaft sleeve 106 to draw the club head 102, adjustment sleeve 104, and shaft sleeve 106 securely toward one another as the screw 116 is tightened. In this way, the screw 116 can also be said to be coaxially aligned with the shaft sleeve 106 and the inner surface 150 and upper outer surface 146 of the adjustment sleeve 104.

The screw 116 can be in contact with a washer or spherical bearing pad 118*a*. The bearing pad 118*a* can be configured to support the head of the screw 116, separating the screw 116 from the flange 176. The bearing pad 118*a* can also have a spherical bearing surface to help ensure the head of the screw 116 has a consistent complementary mating surface for bearing against the bearing pad 118*a* as the lie and loft of the club are adjusted via one or more adjustment sleeves 104. For instance, the bearing pad 118*a* can provide a bearing surface as the screw 116 is positioned at different angles with each change in adjustment sleeve 104 and adjustment value. In some examples, the head of the screw 116 nearest the screw shaft can have a rounded surface to complement the spherical surface of the bearing pad 118*a*. The ring 118*b* situated between the flange 176 and adjustment sleeve 104, can be a washer and/or a retaining ring such that the ring 118*b* can be configured to prevent the screw 116 from falling out of the flange 176 and hosel 114 while changing the adjustment sleeve 104 or adjustment value. In some examples, the screw 116, bearing pad 118*a*, and/or ring 118*b* can be made of steel, titanium, or any other suitable material. Additional details regarding screws, bearing pads, retaining rings, and other aspects of adjustable shaft-head systems are described in U.S. Pat. No. 9,132,323, which is incorporated herein by reference in its entirety.

FIGS. 6 and 8 show that when the golf club fitting system 100 is assembled, the upper portion 124 of the adjustment sleeve 104 can extend between the hosel 114 and the upper portion 160 of the shaft sleeve 106. In particular, the upper annular surface 134 of the shaft sleeve 106 and the upper most edge of the adjustment sleeve 104, i.e., the upper portion 124 which defines the second opening 148, abut one another. The external ridge 136 and notches 140 along the outer surface 146 of the upper portion 124 also abut and receive the upper most edge 142 of the hosel 114 and outwardly extending tabs 138, respectively.

Because the adjustment sleeves 104 are situated between the shaft sleeve 106 and a respective club head 102, 108, the hosel 114 can have decreased or shortened length in comparison to the hosel length of a conventional club head. For example, as shown in FIGS. 6-10, the hosel 114 of the club head 102 (and club head 108) can be shortened by a length equal or nearly equal to the length of the upper portion 124 of the adjustment sleeve 104 exposed (e.g., the upper outer surface 146). This length, which a standard hosel typically spans, extends between the upper portion 160 of the shaft sleeve 106 and the upper most edge 142 and tabs 138 of the hosel 114. In this way, the club fitting system 100 when assembled can be equal or substantially equal in length to the length of a standard hosel and club head used during conventional fittings, thereby maintaining expected golf club lengths that would otherwise be lengthened if the length of the hosel 114 was not decreased. Nevertheless, the adjustment sleeve and hosel of the club fitting systems can have any desired length other than that depicted and/or described herein in light of other perceived advantages.

As shown in FIGS. 7 and 9, in some examples, when the hosel 114 length is relatively shortened and the club fitting system 100 is assembled, the shaft 112 neither enters the hosel 114 nor extends between the tabs 138. For instance, as will be described further, when the club fitting system 100 is assembled, the end portion of the shaft 112 closest to threaded opening 168 and screw 116 can be axially spaced from the upper most edge 142 of the hosel 114, the upper most ends of the tabs 138, and the external ridge 136 of the adjustment sleeve 104. Moreover, in the illustrated examples of FIGS. 7 and 9, only the lower portion 130 of the shaft sleeve 106 enters the hosel 114 and extends between the tabs 138. In particular, in examples where the lower annular surface 164 of the shaft sleeve 106 bears against the transition 128 within adjustment sleeve 104, the middle portion 162 of the shaft sleeve 106 is prevented from extending between a respective pair of tabs 138 and entering the hosel 114.

FIG. 10 shows that when the selected components of the club fitting system 100 are assembled and a club shaft 112 is received by a respective shaft sleeve 106 and adjustment sleeve 104, portions of the shaft sleeve 106 and/or a shaft 112 can be axially offset or spaced from portions of the adjustment sleeve 104 and/or hosel 114. As shown in FIG. 10 for instance, the lower most end of a shaft 112 received within the sleeve bore 172 of the shaft sleeve 106 can be axially offset from the upper most edge of the adjustment sleeve 104 by a length D1. Specifically, the end of the shaft 112 nearest the threaded opening 168 of the shaft sleeve 106 can be axially offset by a length D1 from the upper most edge of the adjustment sleeve 104 which defines the second opening 148. The length D1 can be taken along longitudinal axis A of the adjustment sleeve 104 (FIGS. 5A-5B and 10), for example. In this way, the shaft 112 can be said to extend beyond a plane which intersects the upper most edge and second opening 148 of the adjustment sleeve 104. In this respect, the adjustment sleeve 104 can also be said to circumferentially overlap the shaft 112 along the length D1 when the selected components of the club fitting system 100 are assembled.

As depicted in FIG. 10, the lower most portion of the sleeve bore 172 of the shaft sleeve 106 can be axially spaced from the upper most edge 142 of the hosel 114 and/or external ridge 136 of an adjustment sleeve 104 by a length D2. The length D2 can also be taken along the longitudinal axis A. In this arrangement and in some embodiments, no portion of the shaft 112 lies within or extends beyond a plane intersecting the adjustment sleeve 104 between a plane intersecting the lower most portion of the sleeve bore 172 (i.e., closest to the threaded opening 168) and a plane intersecting the first opening 126. As shown in FIG. 10 for example, no portion of the shaft 112 breaks any plane intersecting or tangential to the external ridge 136 of the adjustment sleeve 104 and/or through the upper most edge 142 of the hosel 114 (FIGS. 7 and 10). By extension, in such embodiments, the shaft 112 neither lies within or extends beyond a plane intersecting or tangential to the tabs 138 of the hosel 114 and/or respective notches 140 of the adjustment sleeve 104 (FIG. 9).

Referring to FIGS. 5B and 10, portions of the adjustments sleeve 104 and shaft sleeve 106 can have lengths relative to one another along the longitudinal axis A. For instance, the outer surface 144 of the lower portion 122 of the adjustment sleeve 104 can have a length D3. The length D3 can extend from the plane intersecting the lower most edge and first opening 126 of the adjustment sleeve 104 to a plane intersecting the external ridge 136. Similarly, the second segment 154 and transition 128 along the inner surface 150 of the adjustment sleeve 104 can have a total length D4. The length D4 can extend along the inner surface 150 from a plane intersecting the second opening 148 to a plane that intersects the inner surface 150 where the first segment 152 and transition 128 meet (e.g., the lower most portion of the transition 128 as illustrated in FIG. 5B). Moreover, as shown in FIG. 10, the threaded opening 168 within the lower portion 130 of the shaft sleeve 106 can have a length D5. In some embodiments, each plane described herein can be perpendicular to and coaxially aligned with one another along the longitudinal axis A.

In some embodiments, the following inequalities may be satisfied. The length D1 between the lower most end of the shaft 112 and the second opening 148 of the adjustment sleeve 104 can be less than the length D2 between the sleeve bore 172 and the upper most edge 142 of the hosel 114 and/or external ridge 136. The length D3 of the lower outer surface 144 of the adjustment sleeve 104 can be greater than the length D2, while the length D4 and length D5 can be greater in length than the length D3. As such, the length D4 and length D5 can be greater in length than both the length D2 and length D1. In some embodiments, the length D2 and length D3 can be equal or substantially equal. In further embodiments, the length D4 can be greater than the length D5.

The lengths D1-D5 can have the following respective measurable quantities. For instance, in some embodiments, the length D1 can have a length ranging from 3 mm to 12 mm with a length ranging from 4 mm to 7 mm as a specific example. The length D2 can have a length ranging from 6 mm to 24 mm with a length ranging from 7 mm to 10 mm as a specific example and the length D3 can have a length ranging from 6 mm to 24 mm with a length ranging from 7 mm to 11 mm as a specific example. The length D4 can have a length ranging from 7.5 mm to 30 mm with a length ranging from either 10 mm to 14 mm, or 12 mm to 18 mm as specific examples, while the length D5 can have a length ranging from 6.5 mm to 26 mm with a length ranging from either 8.5 mm to 13.5 mm, or 11 mm to 16 mm as specific examples. In some embodiments, the length D4 and/or length D5 can be at least 25% greater in length than the length D2 and/or length D3. In further embodiments, the length D4 and/or length D5 can be at least 35% greater in length than the length D2 and/or length D3.

Although described with particularity, these spatial relationships can change as the proportions and/or lengths of the different components are changed. For instance, in examples where the tabs 138 have an extended length, the middle portion 162 of the shaft sleeve 106 can extend between the tabs 138, while the shaft 112 may or may not extend between the tabs. Likewise, the relative axially positioning of the components and/or the lengths D1-D5, and to the extent they differ from one another, can be varied.

Figure 11:
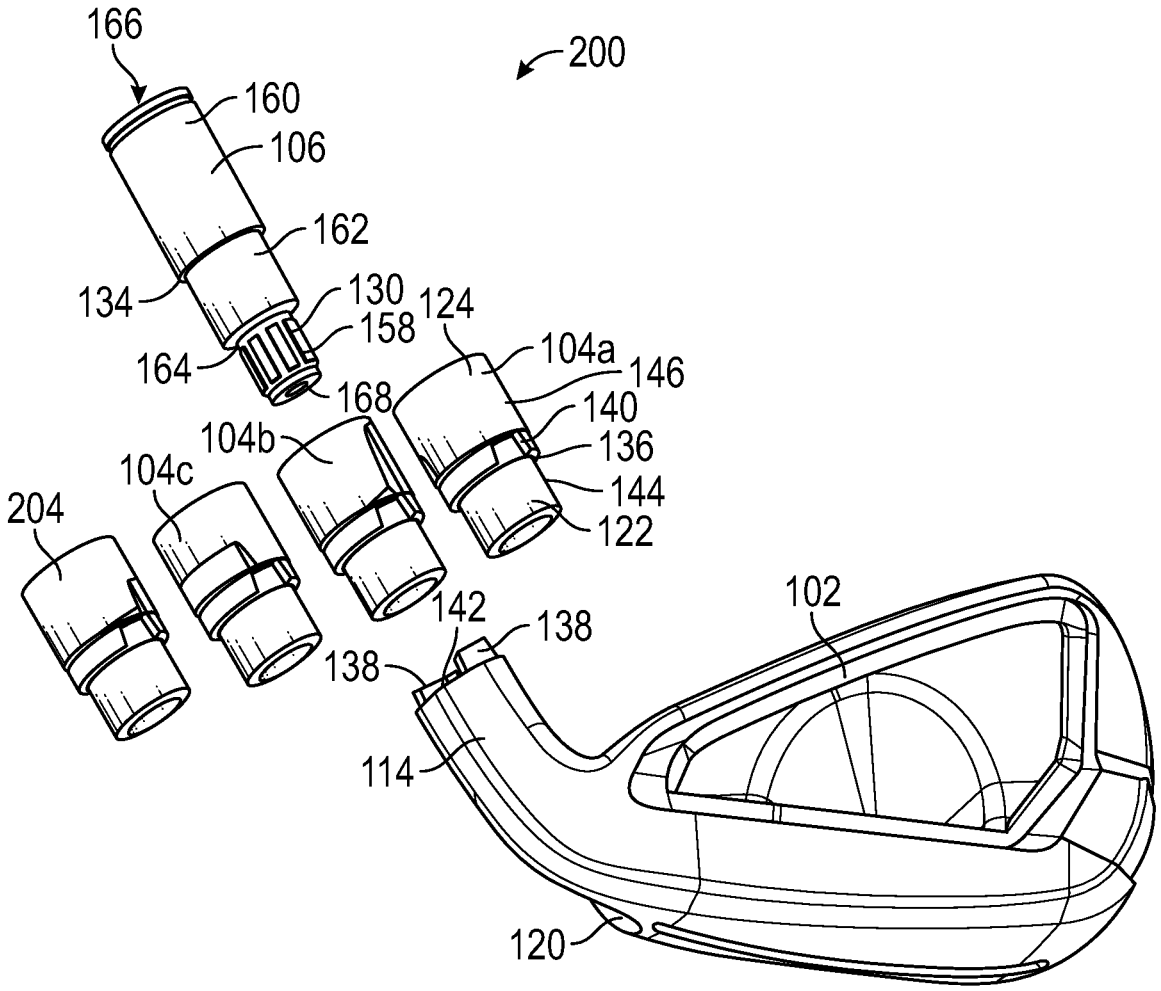
FIG. 11 illustrates another exemplary golf club fitting system.

FIG. 11 depicts another exemplary golf club fitting system 200. The club fitting system 200 can include all of the components as previously described in connection with FIGS. 1-10 and club fitting system 100 except for the lite club head 108, and additionally can include another adjustment sleeve 204 formed and composed of a material to simulate the same advantages and features as provided by the lite club head 108 of club fitting system 100. For example, the club fitting system 200 can include one or more additional adjustment sleeves 204 constructed from a lightweight material to provide the same or similar compensation in swing weight as the lite club head 108 is able to achieve. The mass or weight modified adjustment sleeves 204 can, for example, be made from aluminum (e.g., anodized), steel, titanium, injection molded fiber reinforced (e.g., when a long shaft length is used), higher density metal injected molded tungsten (e.g., when a short shaft length is used) and/or any combination thereof. In some examples, metal injection molded material can be used, with 10-12 g/cc metal injection molded material being one example.

In a similar manner as the lite club head 108, the adjustment sleeve 204 can generally be used to achieve a standard or intended swing weight of a golf club after fitting that club with a relatively long club shaft, such as when fitting the club to a relatively taller golfer. The adjustment sleeve 204 can also be used in combination with a standard-length shaft to alter and achieve a desired swing weight. For example, when desired, a lighter adjustment sleeve 204 can be used to achieve a lighter or lower swing weight, such as a D1 swing weight instead of a D3 swing weight. Similarly, in other examples, a heavier adjustment sleeve 204 may be used to achiever a heavier or higher swing weight such as a D5 swing weight instead of a D3 swing weight. Various combinations of swing weight may be achieved using various configured adjustment sleeves 204, and various swing weights can be fit for various irons throughout a set. For example, a fitter may prescribe a DO swing weight for a 4 iron and a D5 swing weight for a PW (pitching wedge), and this can be achieved during a club fitting using various adjustment sleeves of varying mass.

Figure 12:
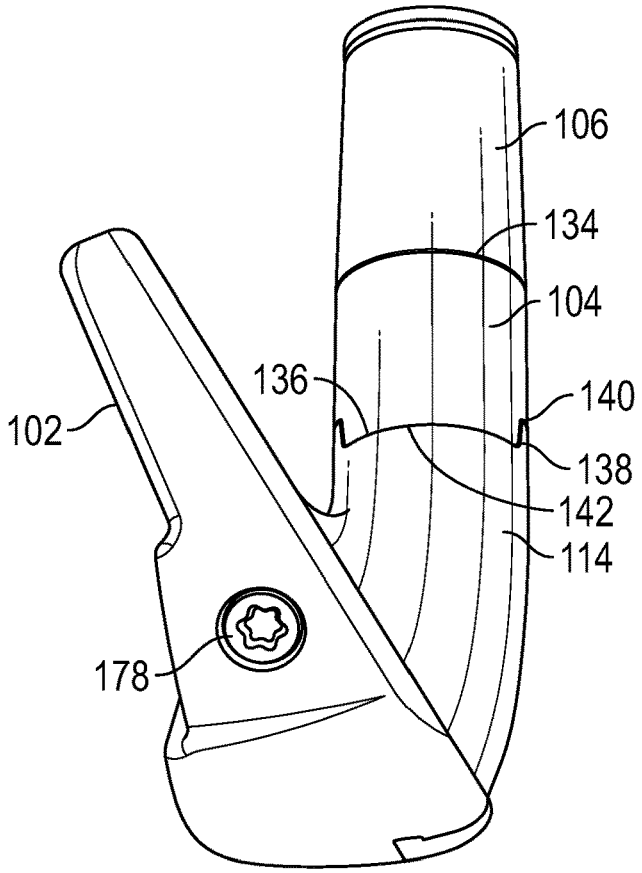
FIG. 12 is a toe side view of an assembled golf club (without a shaft) that includes selected components of the fitting system of FIG. 1.
Figure 13:
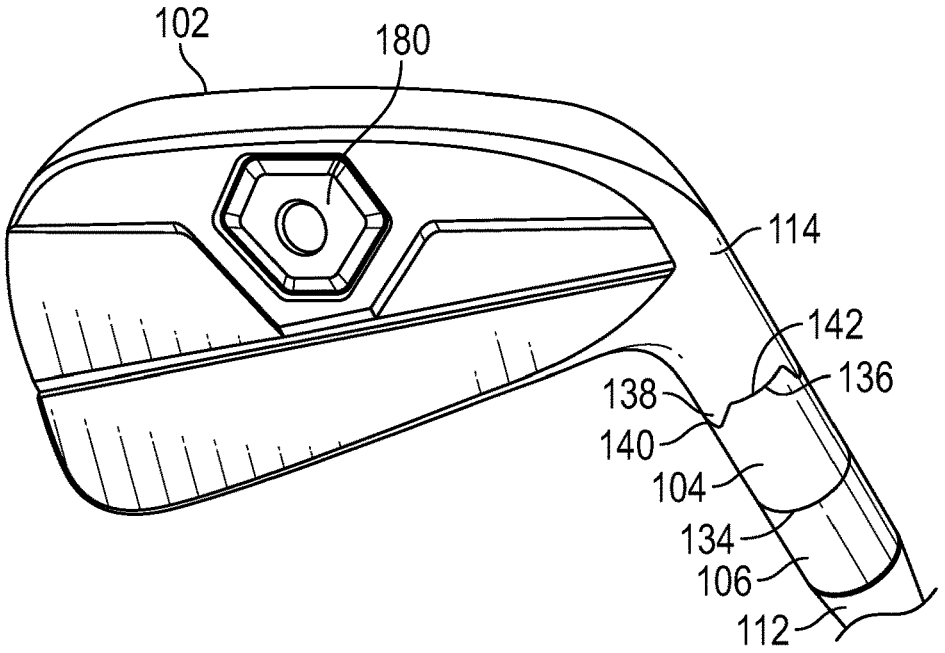
FIG. 13 is a perspective view of another assembled golf club (with a shaft) that includes selected components of the fitting system of FIG. 1.

With reference to FIGS. 12 and 13, rather than using a mass or weight modified adjustment sleeve (e.g., adjustment sleeve 204) as described above, the weight of a club head 102 assembled from components of the club fitting system 100 and/or the fitting system 200 can be increased or decreased via a weighted screw, hosel weight, and/or swingweight. For instance, in one example, the club head 102 shown in FIG. 12, can have a tow screw 178 which can be added or removed to increase and/or decrease the swing weight of the club, respectively. Similarly, as shown FIG. 13, in other examples, the club head 102 of the fitting systems described can include a swingweight 180 which can be coupled and decoupled from the face of the club head to modify the swing weight of the club.

In addition to, or in lieu of using a weighted screw and/or swingweight, a weight situated within the hosel of the club head can also be utilized. For example, in any of the embodiments disclosed herein, a weighted retaining ring and/or washer (e.g., ring 118*b*) can be situated between an adjustment sleeve 104 and the flange 176 within the hosel 114 (e.g., FIGS. 7 and 9). The hosel weight can be changed, for example, as the adjustment sleeves 104 are rotated and/or interchanged, and before, after, and/or during fittings.

The specific embodiments disclosed herein are not limiting of the invention, but rather are examples of a broad array of different embodiments that the inventors have envisioned that include the inventive technology disclosed herein. Any of the features or characteristics disclosed herein can be combined in any way with any of the other features or characteristics disclosed herein, as well as with any other known golf club technologies, to form a variety of different embodiments that include or relate to the inventive technology disclosed herein.

In view of the many possible embodiments to which the principles of this disclosure may be applied, it should be recognized that the illustrated embodiments are only preferred examples and should not be taken as limiting in scope. Rather, the scope of the disclosure is defined by the following claims. We therefore claim all that comes within the scope and spirit of these claims and their equivalents.

The invention claimed is:

1. A golf club fitting system comprising:

a golf club shaft sleeve having a shaft sleeve bore coupled to an end of a golf club shaft;

a golf club head comprising a hosel; and a first adjustment sleeve and a second adjustment sleeve separate from the first adjustment sleeve, each adjustment sleeve comprising an outer surface, an inner surface, and configured to couple to the golf club shaft sleeve and golf club head in a first position and in a second position, wherein when fitting a golf club to a golfer, the first adjustment sleeve is configured to adjust an angle of the golf club head relative to the golf club shaft sleeve by a first angle while in the first position and a second angle while in the second position, and the second adjustment sleeve is configured to adjust an angle of the golf club head relative to the golf club shaft sleeve by a third angle while in the first position and a fourth angle while in the second position, and wherein the first and second adjustment sleeves couple to the hosel of the golf club head and the golf club shaft sleeve separately from one another such that a club fitter can interchange the first and second adjustment sleeves, wherein for each adjustment sleeve, when the adjustment sleeve is coupled to the golf club shaft sleeve and the hosel of the golf club head, the end of the golf club shaft does not enter the hosel and is spaced axially from the hosel such that the golf club shaft is axially offset by a first length from an opening of the adjustment sleeve coupled to the golf club shaft sleeve and proximate the golf club shaft, and the shaft sleeve bore is axially offset from the hosel by a second length that is greater than the first length.

2. The golf club fitting system of claim 1, wherein the first and second angles are equal in magnitude and the third and fourth angles are equal in magnitude, wherein the magnitude of the first and second angles and the magnitude of the third and fourth angles are unequal.

3. The golf club fitting system of claim 1, wherein for each adjustment sleeve, the outer surface has a first longitudinal axis and the inner surface has a second longitudinal axis angled relative to the first longitudinal axis.

4. The golf club fitting system of claim 3, wherein the outer surface comprises a first outer surface having the first longitudinal axis and a second outer surface having the second longitudinal axis and coaxially aligned with the inner surface such that the second outer surface is angularly offset from the first outer surface.

5. The golf club fitting system of claim 1, wherein the golf club head is an iron-type golf club head, and further wherein each adjustment sleeve comprises:

an upper portion external to the hosel, a lower portion received within the hosel, and a ridge abutting the hosel and separating the upper portion from the lower portion.

6. The golf club fitting system of claim 5, wherein the first length is 3-12 mm, and the second length is 6-24 mm.

7. The golf club fitting system of claim 6, wherein the outer surface of the adjustment sleeve comprises a lower outer surface and an upper outer surface, the lower outer surface having a third length that is greater than the first length and the second length.

8. The golf club fitting system of claim 7, wherein the golf club shaft sleeve comprises a threaded opening having a threaded opening length that is greater than the third length.

9. The golf club fitting system of claim 8, wherein the adjustment sleeve circumferentially overlaps the golf club shaft along the first length.

10. The golf club fitting system of claim 9, wherein the threaded opening length is at least 25% greater than the second length, and the third length is 6-24 mm.

11. The golf club fitting system of claim 10, wherein the threaded opening length is at least 25% greater than the third length, and no more than 26 mm.

12. The golf club fitting system of claim 11, wherein the threaded opening length is at least 35% greater than the second length.

13. The golf club fitting system of claim 12, wherein the first length is at least 4 mm, the second length is at least 7 mm, the third length is at least 7 mm, and the threaded opening length is at least 11 mm.

14. The golf club fitting system of claim 11, wherein the golf club head further comprises a removable weight to adjusts a mass of the golf club head.

15. The golf club fitting system of claim 1, wherein for each adjustment sleeve, a plurality of longitudinally extending outer projections of the golf club shaft sleeve is configured to mate with a plurality of longitudinally extending grooves of the inner surface of the adjustment sleeve.

16. The golf club fitting system of claim 1, wherein for each adjustment sleeve, the golf club shaft sleeve, the hosel of the golf club head, and the adjustment sleeve are configured to receive a screw extending therethrough.

17. The golf club fitting system of claim 16, wherein when the golf club shaft sleeve, the hosel of the golf club head, and a respective adjustment sleeve are coupled to one another, the screw is coaxially aligned with the inner surface of the adjustment sleeve.

18. The golf club fitting system of claim 16, wherein when the golf club shaft sleeve, the hosel of the golf club head, and a respective adjustment sleeve are coupled to one another, the screw has a longitudinal axis that is angularly offset from a longitudinal axis of the outer surface of the adjustment sleeve.

19. A golf club fitting system comprising:

a golf club shaft sleeve;

a golf club head comprising a hosel; and a first adjustment sleeve and a second adjustment sleeve separate from the first adjustment sleeve, each adjustment sleeve comprising an outer surface, an inner surface, and configured to couple to the golf club shaft sleeve and golf club head in a first position and in a second position, wherein when fitting a golf club to a golfer, the first adjustment sleeve is configured to adjust an angle of the golf club head relative to the golf club shaft sleeve by a first angle while in the first position and a second angle while in the second position, and the second adjustment sleeve is configured to adjust an angle of the golf club head relative to the golf club shaft sleeve by a third angle while in the first position and a fourth angle while in the second position, wherein the first and second adjustment sleeves couple to the hosel of the golf club head and the golf club shaft sleeve separately from one another such that a club fitter can interchange the first and second adjustment sleeves, and wherein for each adjustment sleeve, the outer surface comprises a first outer surface having a first longitudinal axis, the inner surface has a second longitudinal axis angled relative to the first longitudinal axis, and the outer surface comprises a second outer surface having the second longitudinal axis, with the second outer surface coaxially aligned with the inner surface such that the second outer surface is angularly offset from the first outer surface.

20. The golf club fitting system of claim 19, further comprising a golf club shaft having an end coupled to the golf club shaft sleeve, wherein for each adjustment sleeve, when the adjustment sleeve is coupled to the golf club shaft sleeve and the hosel, the end of the golf club shaft does not enter the hosel and is spaced axially from the hosel of the golf club head.

21. The golf club fitting system of claim 20, wherein the end of the golf club shaft is axially offset by a first length from an opening of the adjustment sleeve coupled to the golf club shaft sleeve and proximate the golf club shaft, a shaft sleeve bore within the golf club shaft sleeve is axially offset from the hosel of the golf club head by a second length, and the second length is greater than the first length.

22. The golf club fitting system of claim 21, wherein the outer surface of the adjustment sleeve comprises a lower outer surface and an upper outer surface, the lower outer surface having a third length that is greater than the first length.

23. The golf club fitting system of claim 22, wherein the golf club shaft sleeve comprises a threaded opening having a threaded opening length that is greater than the third length.

24. The golf club fitting system of claim 23, wherein the golf club head is an iron-type golf club head, each adjustment sleeve comprises an upper portion external to the hosel and a lower portion received within the hosel, and a ridge abutting the hosel and separating the upper portion from the lower portion.

25. The golf club fitting system of claim 24, wherein the threaded opening length is at least 25% greater than the second length, and the third length is 6-24 mm.

26. The golf club fitting system of claim 25, wherein the threaded opening length is at least 25% greater than the third length, and no more than 26 mm.

27. The golf club fitting system of claim 26, wherein the threaded opening length is at least 35% greater than the second length.

28. The golf club fitting system of claim 27, wherein the first length is 3-12 mm, the second length is 6-24 mm, the third length is at least 7 mm, and the threaded opening length is at least 11 mm.

29. The golf club fitting system of claim 25, wherein the golf club head further comprises a removable weight to adjust a mass of the golf club head.

30. The golf club fitting system of claim 25, wherein for each adjustment sleeve, a plurality of longitudinally extending outer projections of the golf club shaft sleeve is configured to mate with a plurality of longitudinally extending grooves of the inner surface of the adjustment sleeve.

31. The golf club fitting system of claim 25, wherein the first and second angles are equal in magnitude and the third and fourth angles are equal in magnitude, wherein the magnitude of the first and second angles and the magnitude of the third and fourth angles are unequal.

* * * * *